US009061174B2

(12) United States Patent
Jun

(10) Patent No.: US 9,061,174 B2
(45) Date of Patent: Jun. 23, 2015

(54) BIKE SADDLE STRUCTURE HAVING ADJUSTABLE OSCILLATION ANGLE AND HEIGHT

(76) Inventor: Woo Sick Jun, Daegu (KR)

( * ) Notice: Subject to any disclaimer, the term of this patent is extended or adjusted under 35 U.S.C. 154(b) by 170 days.

(21) Appl. No.: 13/811,803

(22) PCT Filed: Jul. 22, 2011

(86) PCT No.: PCT/KR2011/005405

§ 371 (c)(1),
(2), (4) Date: Jan. 23, 2013

(87) PCT Pub. No.: WO2012/011763

PCT Pub. Date: Jan. 26, 2012

(65) Prior Publication Data

US 2013/0123074 A1 May 16, 2013

(30) Foreign Application Priority Data

| | | |
|---|---|---|
| Jul. 23, 2010 | (KR) | 10-2010-0071420 |
| Nov. 17, 2010 | (KR) | 10-2010-0114271 |
| Jan. 20, 2011 | (KR) | 10-2011-0005794 |
| Feb. 18, 2011 | (KR) | 10-2011-0014471 |

(51) Int. Cl.

| | |
|---|---|
| ***A63B 22/00*** | (2006.01) |
| ***A63B 22/06*** | (2006.01) |
| ***A63B 21/00*** | (2006.01) |
| ***A63B 22/16*** | (2006.01) |

(Continued)

(52) U.S. Cl.

CPC ..... *A63B 22/06* (2013.01); *A63B 21/00196* (2013.01); *A63B 22/0605* (2013.01); *A63B 22/16* (2013.01); *A63B 23/02* (2013.01); *A63B 22/0046* (2013.01); *A63B 22/0087* (2013.01); *A63B 23/04* (2013.01); *A63B 2022/0635* (2013.01); *A63B 2225/093* (2013.01)

(58) Field of Classification Search

CPC ..... A63B 22/001; A63B 22/0664; A63B 21/225; A63B 22/0015; A63B 21/0053; A63B 2022/0676; A63B 2022/067; A63B 21/0051; A63B 2022/002; A63B 22/0023; A63B 22/203; A63B 21/012; A63B 2022/0682; A63B 21/0058; A63B 21/0088

USPC ..... 482/51–65

See application file for complete search history.

(56) References Cited

U.S. PATENT DOCUMENTS

| | | | | |
|---|---|---|---|---|
| 4,586,706 | A * | 5/1986 | Chen | 482/62 |
| 5,549,527 | A * | 8/1996 | Yu | 482/57 |

(Continued)

FOREIGN PATENT DOCUMENTS

| | | |
|---|---|---|
| JP | 5841679 | 3/1983 |
| JP | 2007061180 | 3/2007 |

(Continued)

*Primary Examiner* — Stephen Crow

(74) *Attorney, Agent, or Firm* — Roberts Mlotkowski Safran & Cole, P.C.

(57) ABSTRACT

The present invention relates to a bike saddle structure in which the oscillation angle and height of a bike saddle are adjustable, and to an exercise bicycle comprising same. Vibrations in the bike saddle are minimized and the stability thereof is ensured during the left and right oscillation of the bike saddle, thus enabling a rider to exercise his/her whole body including the legs, pelvis, spine, abdomen, etc. over a long period of time. The forward and backward direction and height of the bike saddle are adjustable by the rider, thus providing a wide range of exercise.

6 Claims, 21 Drawing Sheets

(51) Int. Cl.
*A63B 23/02* (2006.01)
*A63B 23/04* (2006.01)

(56) References Cited

U.S. PATENT DOCUMENTS 7,427,256 B2 * 9/2008 Fan ..... 482/64
7,867,146 B2 * 1/2011 Ge et al. ..... 482/51
7,931,573 B2 * 4/2011 Shinomiya et al. ..... 482/142
8,323,156 B2 * 12/2012 Ozawa et al. ..... 482/95
8,376,915 B2 * 2/2013 Hu ..... 482/57

FOREIGN PATENT DOCUMENTS

KR 200156862 9/1999
KR 1020000073755 A 12/2000
KR 200334981 12/2003
KR 200418024 6/2006
KR 1020060094933 A 8/2006
KR 1020070038636 A 4/2007
KR 2020080003892 8/2008
KR 1020100016866 A 2/2010

* cited by examiner

BIKE SADDLE STRUCTURE HAVING ADJUSTABLE OSCILLATION ANGLE AND HEIGHT

CROSS-REFERENCE TO RELATED APPLICATION

This application claims the benefit of Korean Patent Application No.10-2010-0071420, filed on Jul. 23, 2010 and Korean Patent Application No.10-2010-0114271, filed on Nov. 17, 2010 and Korean Patent Application No.10-2011-0005794, filed on Jan. 20, 2011 and Korean Patent Application No.10-2011-0014471, filed on Feb. 18, 2011 in the Korean Intellectual Property Office, the disclosure of which is incorporated herein by reference.

TECHNICAL FIELD

The present invention relates to a saddle structure for a health bike and in particular to a saddle structure for a health bike which is configured to oscillate in leftward, rightward, upward and downward directions and makes it possible to eliminate any interferences with an external construction in such a way to prevent a series elements belonging to the construction of a saddle from being exposed to the outside while an instrument apparatus operates in consideration of a user's safety and outer appearance.

In addition, the present invention relates to an oscillating saddle apparatus of a health bike which makes it possible to easily adjust the height of a saddle and to achieve leftward and rightward oscillations with the aid of a pedaling.

The present invention relates to a pedal exercise apparatus which can be used indoors and in particular to a health bicycle with an oscillation angle adjusting apparatus of the saddle which can provide legs and waist exercises through a pedaling.

In addition, the present invention relates to a health bike with a stable leftward and rightward oscillation unit for a saddle in which a stable and horizontal reciprocation motion is possible using a linear motion (LM) guide or a linear bush as a leftward and rightward oscillation unit and a long time leg exercise as well as an exercise of the whole body portions such as a pelvis, a vertebra and an abdomen can be possible.

BACKGROUND ART

Many office workers and students spend their times sitting on chairs which cause diseases such as abdominal obesities, constipation, etc. Since they spend most of their times working on computers, patients who suffer scoliosis increase.

The scoliosis represents a phenomenon that a normal vertebra supporting the center of a human body is bent leftward or rightward. When the vertebra is bent, a vertebra muscle such as a rhomboid muscle comes to receive persistent stresses, so the patient suffers a chronic fatigue, a low back pain, a headache or a disk disease. The above mentioned diseases might prevent young persons in their growth periods from normal growths.

As described above, it is essential for a person to do an exercise which is directed to enhance a right posture and waist power so as to prevent an abdominal obesity, constipation, a scoliosis, etc. which derive from a bad life habits.

A conventional cycling exercise apparatus with pedals is widely used as a representative aerobic exercise apparatus configured to train low bodies. The above mentioned conventional exercise apparatus uses the forces coming from two legs like a typical bicycle for thereby effectively strengthening the muscle powers of low bodies. So, it is not proper to a waist exercise planned to prevent constipation and abdominal obesity and to strengthen vertebra.

According to the Korean registered utility model number 20-0418024 filed on Mar. 14, 2006 by the same applicant as the present invention, it is directed to an oscillation structure for a bicycle saddle having features in that it is hinged at a frame for a support shaft of a saddle body to be pivot in leftward or rightward directions, and a crank shaft with an eccentric portion is rotated by a pedal operation. When an ascending and descending operation of a connection rod coupled to the eccentric portion is performed, the leftward and rightward oscillations are performed in the saddle body. The above mentioned invention has a problem in that it is hard to adjust the oscillations and the height of the saddle.

According to the Korean patent publication number 10-2010-0016866 filed on Aug. 15, 2008 by the same applicant as the present invention, a health bicycle with a leftward and rightward oscillating structure of a saddle comprises a pedal part 3000 and a saddle part 7000 in which a pedal and a driving sprocket are installed at both sides of a crank shaft installed at a frame, and at least driven sprocket is connected to the driving sprocket by way of a chain, and the driven sprocket rotates in sync with the rotation of the crank shaft. A fixing bracket with an are-shaped gear is axially installed at a lower side of the saddle, and the saddle part 7000 is configured for the arc-shaped gear to receive leftward and rightward pivoting forces from the gear part and to perform leftward and rightward pivoting operations. Between the driving sprocket and the driven sprocket rotating in sync with the driving sprocket is eccentrically installed an end portion of the connection rod. The gear part and the pedal part 3000 are configured to form an eccentric link structure by way of a connection rod. The rotational force of the pedal part 3000 is converted into a reciprocating pivoting force, and the converted force is provided to the gear part by way of the connection rod. The saddle part 7000 tooth-engaged with the gear part by way of the arc-shaped gear pivots in leftward and rightward directions by receiving the reciprocating pivoting force of the gear part for thereby oscillating in leftward and rightward directions. However, it is inconvenient for a user to adjust the connection rod when adjusting the oscillation angle and the height of the saddle.

According to the Korean patent registration number 10-0931849, the diet and rehabilitation apparatus using oscillations comprises a saddle disposed at an upper side of the base, a first rotary shaft and a second rotary shaft which are spaced apart from each other and are rotatably installed at the base, a pair of main pedals rotating the first rotary shaft, a driving force transfer part connected with the first and second rotary shafts and transferring a rotational force from one of them to the other one, a cam having a certain cam profile on an outer surface of the second rotary shaft, a cam roller rolling depending on the rotation of the cam while it is in contact with the outer surface of the cam and reciprocating, a saddle support part to which the cam roller is rotatably engaged and which supports the saddle, and a motion conversion part enabling the saddle to ascend and descend by converting the rotational motion of the second rotary shaft into a straight reciprocation motion. However, the above mentioned apparatus has a problem in that unnecessary double pedals are installed, and the construction is complicated, and it is hard to adjust the oscillating angles.

The Japanese patent publication number 2002-210037 discloses an exercise apparatus comprising a handle part 2000 that a user holds, a saddle part 7000 for a user to sit on and a pair of pedal and crank parts helping to perform a rotational motion of the pedal and crank parts with the aid of the stepping motions of two feet. There is provided a crank apparatus having features in that the rotational motion is performed in sync with the rotational motions of the pedal and crank parts, and the rotational motion of the pedal and crank parts is converted into an oscillating motion of the saddle part 7000 by using the eccentric member connected with the saddle part 7000 at the position eccentric from the center of the rotations. However, since the oscillation fixing point is leaned toward the downward side, the user's stability is bad, and collapse might occur, and it is inconvenient and hard to adjust the oscillating angles.

The Korean utility mode publication number 20-2007-0001101 discloses an oscillated fitness bicycle structure comprising an eccentric portion on a first driving apparatus, a driving rod which is integral with the handle support rod and is arranged on the saddle support rod, a vibration rod which is connected with the handle support rod and the saddle support rod and moves forward and backward, and an elastic element providing a bounce in the upward direction. When an exerciser sits on the saddle, the weight of the exerciser causes the saddle support rod to be pushed downward, and two driving rods enable the driving wheel of the first driving apparatus and the weight wheel of the second driving apparatus to rotate, and the handle support rod and the saddle support rod oscillate upwards and downwards so as to generate a motion which is similar with the horse riding motion, and a lateral oscillation can be performed. However, it is hard to adjust the leftward and rightward oscillation angles of the saddle and the upward and downward motion span.

*Patent Documents*

Korean Utility Model Registration Number 20-0418024

Korean Patent Publication Number 10-2010-0016866

Korean Patent Registration Number 10-0931849

Japanese Patent Publication Number 2002-210037

Korean Utility Model Publication Number 20-2007-0001101

DISCLOSURE OF INVENTION

Accordingly, it is an object of the present invention to provide a saddle structure of a health bike having an oscillation structure in leftward, rightward, forward and backward directions.

It is another object of the present invention to provide a leftward and rightward oscillation structure which helps adjust the height of a saddle of a health bike.

It is further another object of the present invention to provide a health bike with an oscillation apparatus and a saddle part which comprises a handle part fixed on a base frame supporting and fixing an exercise apparatus, a pedal part helping for a user to perform a cycling as the user steps with his both feet on the same for thereby performing an exercise, a driving pulley and a driving sprocket which are engaged to the pedal part and perform a rotation motion, and a rotation torque adjusting part adjusting the rotational torque of the driving pulley. The user sits on an exercise apparatus helping the user to do a leg exercise and a waist exercise at a fixed position of an indoor space while the sit user oscillates his waist in the leftward and rightward directions.

It is still further another object of the present invention to provide a health bike with a stable leftward and rightward oscillation part of a saddle which makes it possible to do the whole body exercises for a pelvis, a vertebra and an abdomen including legs for a long time because a stable and horizontal motion is possible as a linear motion (LM) guide or a linear bush is used as a leftward and rightward oscillation part.

To achieve the above objects, according to one aspect of the present invention, there is provided a health bike saddle structure, comprising an operation part to which a rotational force is supplied from a driving force of pedals; a leftward and rightward driving part the position of which changes in leftward and rightward directions by the rotations of the operation part; and a forward and backward driving part which is fixedly engaged at the top of the leftward and rightward driving part and is engaged with a saddle, so the positions of the same can be adjusted in forward and backward directions, and the leftward and rightward driving part and the forward and backward driving part are integrally engaged by way of a bracket fixed at the top of the leftward and rightward driving part, and as the operation part is engaged with an inner side of the leftward and rightward driving part and rotates in one direction, the positions f the leftward and rightward driving part can be changed.

In addition, the operation part comprises an oscillation body support part which has a hollow interior; a driving force transfer shaft which is inserted into an inner space of the oscillation body support part for the driving force of the pedals to be transferred by arranging a worm gear at a lower side of the same; a rotary shaft which is positioned overlapped with the top of the driving force transfer shaft and rotates in sync with the driving force transfer shaft; a gyroscope which is bolt-engaged in a perpendicular direction at the top of the rotary shaft; and a pressurizing protrusion which is fixedly engaged at an end portion of the gyroscope.

In addition, the leftward and rightward driving part comprises a spike whose bottom is formed in a rectangular frame shape; a pair of guide shafts which are arranged crossing the side surface at the inner side; an engaged ball bush; a guide frame which is engaged at an inner upper surface of the lock; and a bracket integrally engaging the front and back driving part and the supporting housing.

In addition, the front and back driving part comprises a pair of guide shafts which are installed opposite to each other in a longitudinal direction of the saddle; a support holder supporting the saddle by fixing both ends; and a ball bush for fixedly engaging both ends.

In addition, a plurality of fixing plates are fixedly arranged on the same line at the top of the oscillation body support part, and the ball bush of the leftward and rightward driving part is engaged to the fixing plate, so the position of the ball bush engage to the guide shaft does not change.

In addition, the pressurizing protrusion of the operation part is arranged in engagement with the guide frame provided at the leftward and rightward driving part and allows the pressurizing protrusion held by the guide frame to linearly reciprocate in a space formed by the guide frame.

In addition, as the pressurizing protrusion pushes one side of the guide frame by means of the rotational operation of the rotary shaft and the gyroscope, the position of the support housing changes in the leftward and rightward directions about the ball bush.

In addition, the ball bush of the frontward and backward driving part further comprises a plate at the bottom for the sake of fixing and engagement with the bracket, and as the positions of the guide shaft and the support holder change about the ball bush, the front and back positions of the saddle change.

According to another aspect of the present invention, there is provided a health bike saddle structure in a leftward and rightward oscillation construction of a bike saddle structure in which the oscillation angle and height of a bike saddle are adjustable, comprising a saddle part of a lower side of the saddle, the saddle support being inserted into a saddle part engaging part, and a hinge disposed between the saddle part engaging part and the lower saddle part, and a height-adjustable lower saddle part is inserted into the saddle part support part and is fixed by a fixing key, and a cable disk provided at both sides of a sprocket provided at one side of the saddle part support part and rotating generates a rotational force by receiving a rotational force of the pedals through a chain, and a wire fixing roller provided at one side of the cable disk and being rotatable about an axis of the wire fixing roller shaft is configured to have a 180° angle difference, and one end of a wire at an inner side of the cable is fixed at each wire fixing roller, and the other end of the wire is fixed at a wire fixing clamp provided at both sides of the saddle part engaging part, and the pedaling causes each cable disk to rotate with an angle difference of 180°, and a wire in each cable fixed at a cable fixing clamp 2 provided at both sides of the saddle part support part and a cable clamp 1 provided at both sides of a lower saddle part is tensioned and loosened in opposite directions, so the wire fixing clamp of both sides of the saddle part engaging part is tensioned and loosened in opposite directions, thus easily adjusting the height of the saddle, and the saddle can oscillate in leftward and rightward directions by the pedaling.

According to further another aspect of the present invention, there is provided a health bike in exercise instrument which can help perform a leg exercise and a waist exercise at a fixed place in an indoor space by comprising a base frame supporting and fixing an exercise instrument, a handle part fixed at the base frame, a pedal part for performing a cycling exercise as a user pedals with his feet on the same, a driving pulley and a driving sprocket integrally engaged with the pedal part for the sake of a rotational operation, and a rotation torque adjusting means adjusting a holding force of the driving pulley, a saddle part which oscillates in leftward and rightward directions as a user sits on the same.

There are provided an oscillation instrument having features in that as a user pedals sitting in a saddle, the driving sprocket engaged with the pedal crank rotates and transfers a driving force to the driven sprocket for thereby performing an eccentric operation in sync with the bevel gear integrated to the driven sprocket, and an oscillation saddle which is configured to cause the saddle part to perform a leftward and rightward oscillation motion by using the eccentric motion of the oscillation instrument and has an oscillation adjusting part adjusting the span of the oscillation motions.

According to other aspect of the present invention, there is provided a health bike having a leftward and rightward oscillation saddle means in the construction of a health bike having a means helping a saddle of a health bike to oscillate in leftward and rightward and horizontal directions with a driving force, comprising a driving force generation part formed of pedals, a crank arm, a sprocket 1 and a pedaling disk, and when a user pedals on the pedals, a rotational force generates in proportion to the length of the crank arm about the crank rotary shaft; a driving force transfer part formed of a chain, a sprocket, a bevel gear, a bevel gear, a driving force transfer shaft and a universal joint, and a chain is disposed between the sprocket and the sprocket, and a rotational force of the sprocket is transferred to the sprocket provided at the oscillation body support part, and a bevel gear is engaged on the same axis as the sprocket, so it can rotate together, and a bevel gear is engaged vertically at the bevel gear and rotates together, and a driving force transfer shaft is connected in the direction of the rotary shaft of the bevel gear, and a universal joint is provided at the other end of the driving force transfer shaft, so the rotational force of the driving force generation part is transferred to the rotary shaft of the leftward and rightward oscillation apparatus part or the driving force generation part is formed of pedals, a crank arm, a pulley and a pedaling disk, and when a user pedals on the pedals, a rotational force generates in proportion to the length of the crank arm about the crank rotary shaft, and the driving force transfer part is formed of a driving force transfer belt or gear, a pulley, a bevel gear, a bevel gear, a driving force transfer shaft and a universal joint, and a driving force transfer belt is disposed between the pulley and the pulley, and a driving force of the pulley is transferred to the pulley provided at the oscillation body support part, and a bevel gear 1 is engaged on the same axis as the pulley and rotates together, and a bevel gear 2 is engaged at a right angle at the bevel gear 1 and rotates together, and a driving force transfer shaft is connected in the direction of the rotary shaft of the bevel gear 2, and a universal joint is provided at the other end of the driving force transfer shaft, and a rotational force of the driving force generation part is transferred to the rotary shaft of the leftward and rightward oscillation apparatus part 2, and the rotary shaft of the leftward and rightward oscillation apparatus part 1 is engaged at the universal joint, and the rotary shaft of the leftward and rightward oscillation part is engaged at the universal joint and rotates at the inner side of the long bush , and the other end of the rotary shaft is fixed at the rotation disk, and the disk roller 87 above the rotation disk 90 performs an eccentric rotation motion about the rotary shaft of the rotation disk 90, and the disk roller is inserted into the inner side of the roller guide, and the roller guide is engaged with the oscillation body base plate 1, the roller slide, the connection post, and the post fixing piece and operate like one body, and as the disk roller performs an eccentric rotation motion about the rotary shaft of the rotation disk, the oscillation body base plate 1, the roller slide, the connection post, the post fixing piece and the roller guide linearly reciprocate like the oscillation body base plate 1 in the leftward and rightward directions along the guide rail, the rotary shaft of the leftward and rightward oscillation apparatus part 1 is engaged at the universal joint, and the rotary shaft is engaged at the universal joint and rotates at the inner side of the long bush, and the other end of the rotary shaft is fixed at the rotation disk, and the disk roller above the rotation disk performs an eccentric rotation motion about the rotary shaft of the rotation disk, and the disk roller is inserted into the inner side of the roller guide, and the roller guide is engaged with the oscillation body base plate 2, the linear bush, the connection post and the post fixing piece and operates line one body, and as the disk roller performs an eccentric rotation motion about the rotary shaft of the rotation disk, the oscillation body base plate 2, the linear bush, the connection post, the post fixing piece and the roller guide linearly reciprocate in leftward and rightward directions along with the oscillation body base plate 2, and the health bike means part comprises a saddle, a saddle rest, a handle bar, a head tube, a head tube support part, a flywheel, a support part and an oscillation body support part, and the saddle rest is provided at the top of the oscillation body base plate 1, and the saddle is engaged at the top of the saddle rest for the user to adjust the saddle at a desired angle, and the handle bar is configured for a user to support his body with hands holding the same, and the head tube supporting the handle bar and the head tube support part supporting the head tube are fixed at the support part, and the flywheel rotates by receiving a rotational force of the pedaling disk through the flywheel belt, and the support part is engaged with the head tube support part and the oscillation body support part and operates like the basic frame, and the driving force generation part, the driving force transfer part, the leftward and rightward oscillation apparatus part 1 and the health bike means part are provided.

Advantageous Effects

The present invention provides a saddle structure in which an oscillation angle and a height can be adjusted and a health bike with the same by which the following effects can be obtained.

(a) Using the saddle structure of the present invention, the whole bodies' exercise such as a leg exercise, pelvis and a vertebra exercises, an abdomen exercise, etc. can be effectively performed for a long time by minimizing the vibrations during a left and right horizontal oscillation of the saddle and obtaining a safety. Since the saddle can be driven in forward and backward directions by means of a user's artificial operations, a wide range of exercise ranges can be provided.

(b) The key elements organically connected for the sake of the movable structures of the saddle which are driven in the forward, backward, leftward and rightward directions are arranged hidden from the outside for thereby perfectively coping with the possible safety accidents during the use.

(c) The height of the saddle can be adjusted depending on the body's physical conditions of the user in such a way to use a cable and a wire, not a mechanical structure fixed at the leftward and rightward oscillation structure of the saddle. The provision of the leftward and rightward oscillation part of the saddle helps the user do a waist exercise as the saddle oscillates in the leftward and rightward directions.

(d) The user can do low body and leg exercises with a cycling exercise instrument designed to be pedaled by a user and can also do a waist exercise with the function that the saddle oscillates in leftward and rightward directions. In addition, the leftward and rightward oscillation widths of the saddle can be easily adjusted in conformity with the body type and exercise level with the aid of the eccentric and oscillation mechanics. The office workers and students who spend most of their times sitting in the chairs in unbalanced postures might have good effects in preventing and curing the abdominal obesity, constipation, scoliosis, etc. since the exercise apparatus of the present invention helps concurrently perform the leg and waist exercises.

(e) When the leftward and rightward oscillation part of the saddle of the present invention is made of a LM guide (linear motion guide) or a linear bush, the oscillations during the leftward and rightward horizontal oscillations of the saddle at the time of the pedaling can be minimized while securing the safety, so the whole bodies' exercises including a leg exercises, pelvis and vertebra exercises and an abdominal exercise can be performed for a long time by providing the leftward and rightward oscillation part of the saddle belonging to the health bike.

BRIEF DESCRIPTION OF DRAWINGS

FIG. 21*b* is an extracted perspective view illustrating a slide frame, a guide shaft and a linear bush of a leftward and rightward oscillation apparatus part 2(S4).

LEGENDS OF REFERENCE NUMERALS

Figure 1:
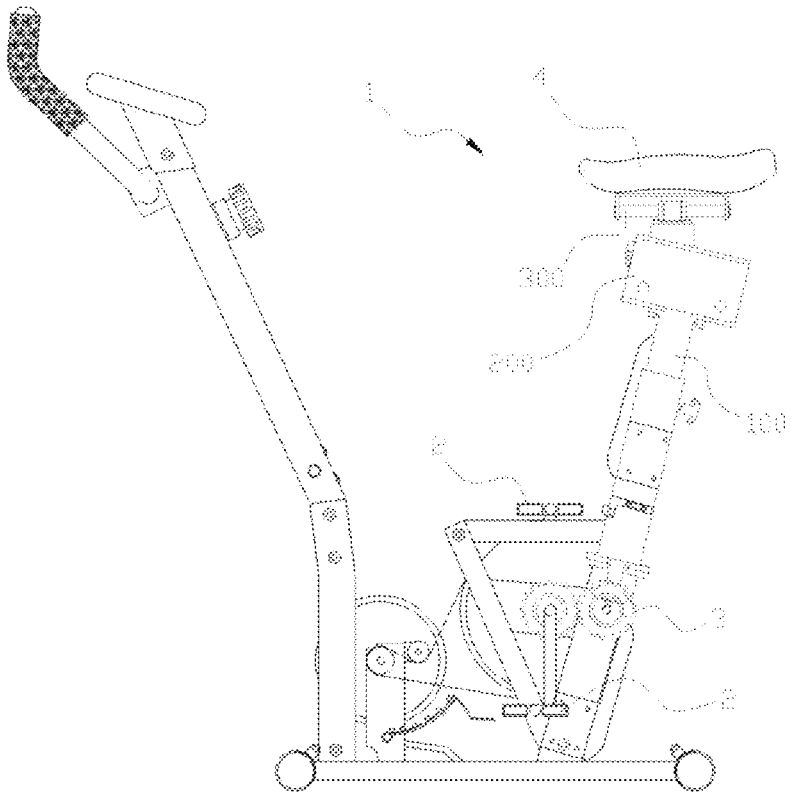
FIG. 1 is a front view illustrating the construction of a preferred embodiment of the present invention.

1: health
2: pedal
3: sprocket
4: saddle
5: leftward and rightward oscillation saddle part
10: base frame
11: main fame
12: support frame
13: crank arm
14: crank rotary shaft
15: sprocket 1
16: sprocket 2
20: saddle part
21: handle part
22: indicator
23: handle support part
24: handle bar
25: height adjusting part
30: fixing key
31: driving sprocket
34: driving pulley
35: belt
40: saddle part engaging part
41: saddle part supporting part
42: rotation torque adjusting mean
43: rotation drum
44: friction pad
45: wire fixing clamp
46: bevel gear 1
47: bevel gear 2
50: wire
51: driven sprocket
52: horizontal rotation bevel gear
53: vertical rotation bevel gear
54: horizontal shaft
55: bearing and bearing housing
56: external rotary shaft
56*a*: internal rotary shaft
57 eccentric adjusting part
57*a*: spherical roller
57*b*: eccentric part
57*c*: eccentric part horizontal shaft
57*d*: adjuster
57*e*: fixing pin
57*f*: eccentric adjusting hole
57*g*: fixing pin insertion hole
57*h*: vertical rotary shaft
60: cable
61: oscillation transfer part
63: oscillation shaft
64: universal joint
65: oscillation link part
67: roller slide
68: connection post
70: hinge
71: post fixing piece
72: saddle hinge
75: guide rail
77: cable fixing clamp 1
78: cable fixing clamp 2
79: lower saddle part
80: cable disk
81: roller guide
85: wire fixing roller
86: wire fixing roller shaft
87: disk roller
91: rotation disk
95: slide frame
96: chain
100: operation part
105: long bush
101: stem
110: oscillation body support part
111: oscillation body base plate
112: oscillation body base plate 2
120: driving force transfer shaft
121: worm gear
122: key groove
125: linear bush
130: rotary shaft
132: flywheel
133: pedaling disk
135: belt
136: shaft holder
140: gyroscope
141: roller
145: rail support part
146: head tube
150: pressurizing protrusion
151: head tube support part
156: flywheel belt
160: fixing plate
161: slide
165: support part
170: wire fixing part
172: saddle rest
180: LM guide
200: leftward and rightward driving part
201: driving force transfer belt
210: ball bush
211: pulley
215: shaft
220: support housing
221: lower gear
230: bracket
240: guide shaft
250: guide frame
300: forward and backward driving part
310: support holder
340: plate
2000: handle part
3000: pedal part
5000: oscillation instrument
6000: oscillation adjusting part
7000: saddle part
S1: driving force generation part
S2: driving force transfer part
S3: leftward and rightward oscillation apparatus part 1
S4: leftward and rightward oscillation apparatus part 2
S5: health bike apparatus part

BEST MODES FOR CARRYING OUT THE INVENTION

The present invention is directed to implementing the structure (1) of the saddle so as to properly vary the position in leftward, rightward, forward and backward directions in an attempt to maximize the effects of exercises.

The construction, operation and effects of the present invention will be described in details with reference to the accompanying drawings.

The advantages and features of the present invention and the method for implementing the same will be clarified with reference to the embodiments along with the drawings. It should be understood that the present invention is not limited to the embodiments which will be disclosed below, but it can be implemented in different ways while making sure that the disclosure of the present invention becomes perfect, and an ordinary person skilled in the art belonging to the present invention can be informed of the scope of the present invention, and the present invention should be defined within the scope of the claims, and the same reference numerals represent the same construction elements throughout the specification.

Figure 2:
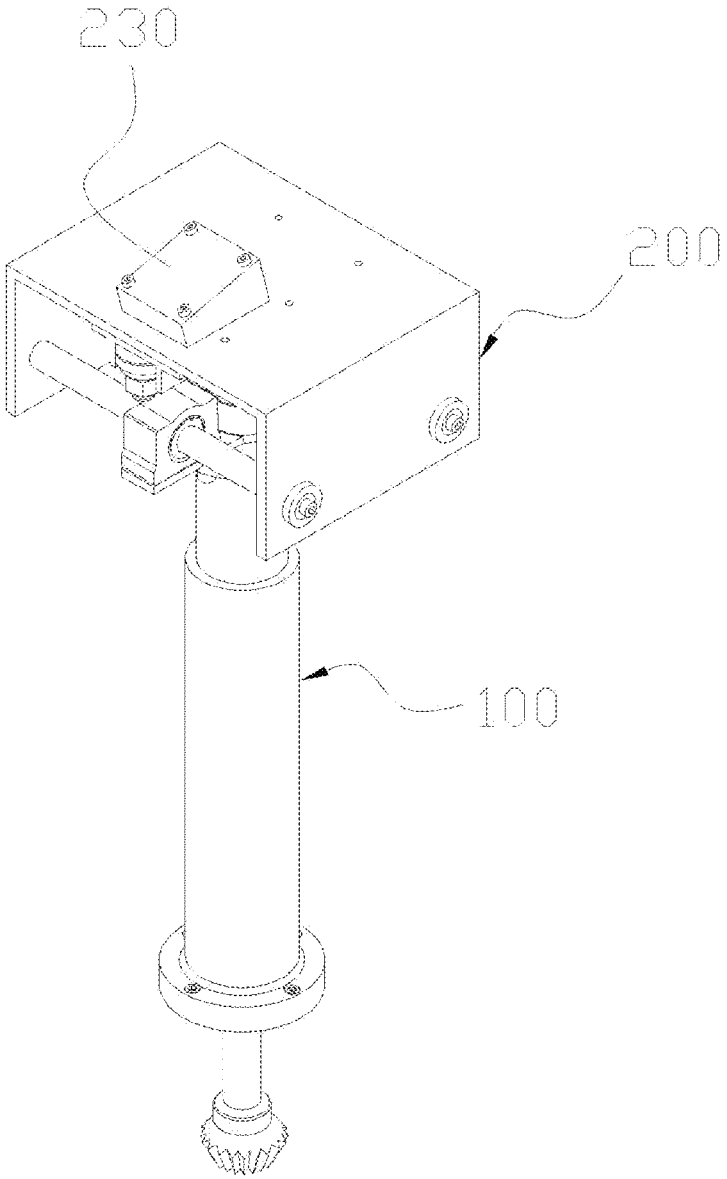
FIG. 2 is a perspective view illustrating a key part of the present invention.
Figure 3:
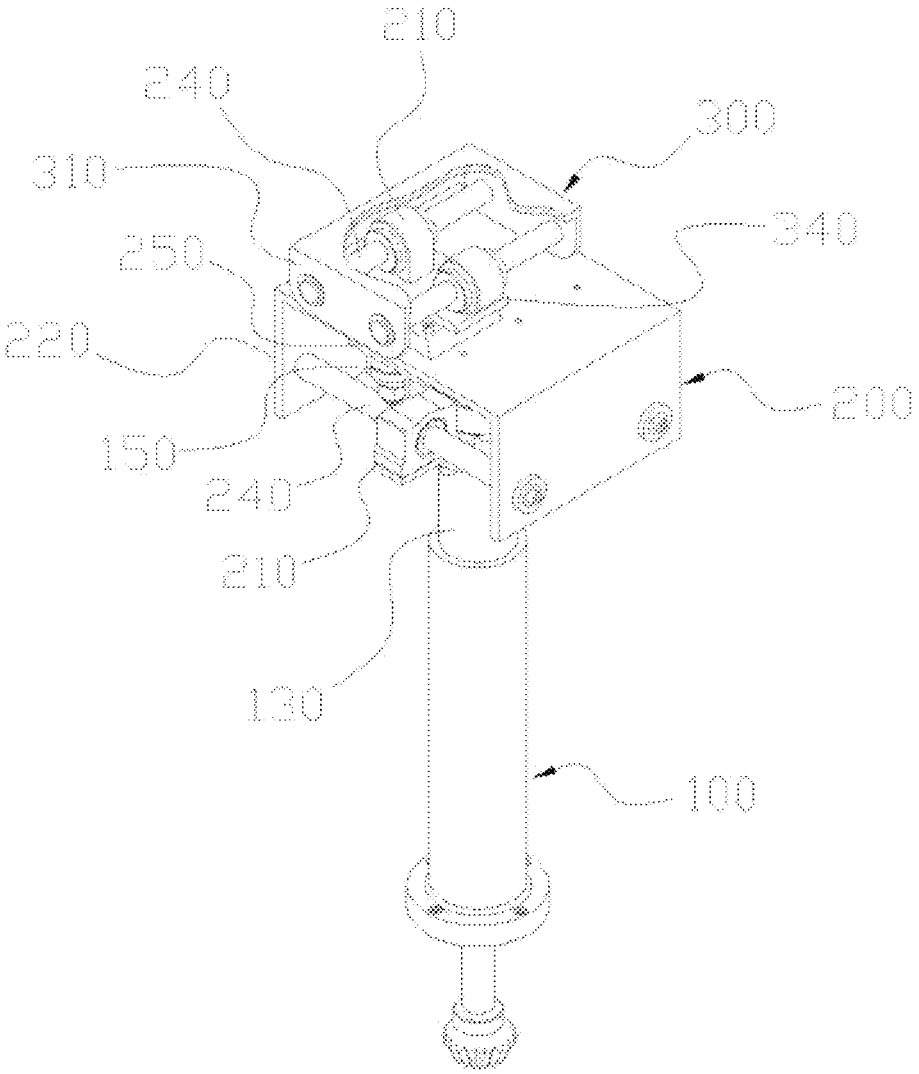
FIG. 3 is a perspective view illustrating the engaged construction of another key part of the present invention.

FIG. 1 is a front view illustrating the construction of a preferred embodiment of the present invention, and FIG. 2 is a detailed view showing the major elements of the present invention, and FIG. 3 is a view showing the engagement of another major part of the present invention.

As shown in FIGS. 1 to 3, the present invention comprises an operation part 100, a leftward and rightward driving part 200 and a forward and backward driving part 300. The leftward and rightward driving part 200 is driven by an interoperation of the operation part 100. The forward and backward driving part 300 is configured to be selectively driven by a user.

The operation part 100 is an essential element which is given a rotational force by means of the driving force of the pedal 2. As shown in FIG. 1, the pedal 2 generating a driving force can be configured by inter-engaging the sprocket 3 as shown in FIG. 1. It might be formed in an ordinary chain type (not shown).

The leftward and rightward driving part 200 is an essential element the positions of which are adjusted in leftward and rightward directions by means of the rotational operation of the operation part 100. Actually, as the leftward and rightward positions of the saddle 4 can be properly varied by the pedaling of the pedal 2 by the user, it is possible to maximize the effects of exercises. Series elements are hidden from the outside for the sake of a users safety, and the whole portions of the support housing 220 oscillates in leftwards and rightward directions by the fixed type ball bush 210 which will be described later or the LM for thereby obtaining a desired object.

The forward and backward driving part 300 is an essential element and is engaged with the saddle 4 by way of an engaging part such as a fixing bolt, etc. at the upper side of the leftward and rightward driving part 200, so that the position of the same can be adjusted in the forward and backward directions. The forward and backward driving part 300 is formed in a structure driven within the same ranges as the support holder 310 along with the saddle 4 fixed at the upper side. The above mentioned construction helps adjust the leftward and rightward positions with the aid of the leftward and rightward driving part 200 as well as the forward and backward positions of the saddle 4, so the user can voluntarily or involuntarily enlarge the ranges of the exercises depending on the users choice.

The leftward and rightward driving part 200 and the forward and backward driving part 300 are integrally engaged by way of the bracket 230 fixed at the upper side of the leftward and rightward driving part 200 and the operation part 100 is engaged with an inner side of the leftward and rightward driving part 200 and rotates in one direction, so the position of the leftward and rightward driving part 200 changes. The above described construction will be described in details with reference to FIGS. 4 and 5.

Figure 4:
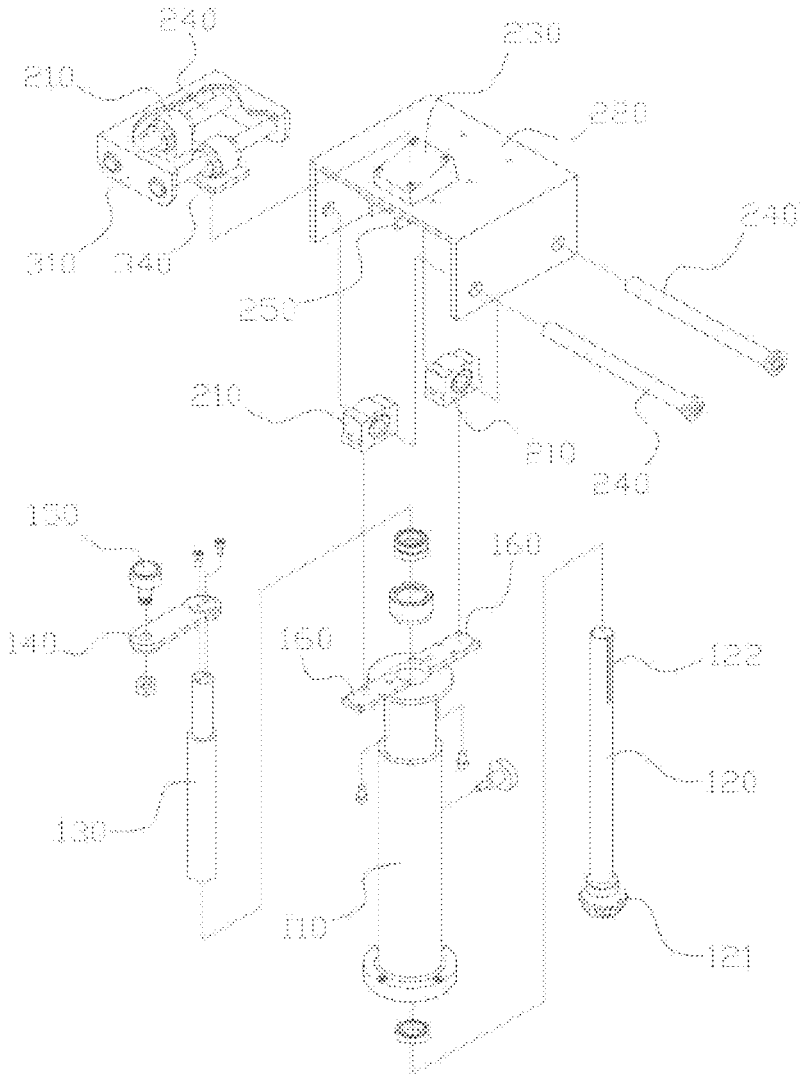
FIG. 4 is a disassembled perspective view illustrating the construction of a preferred embodiment of the present invention.
Figure 5:
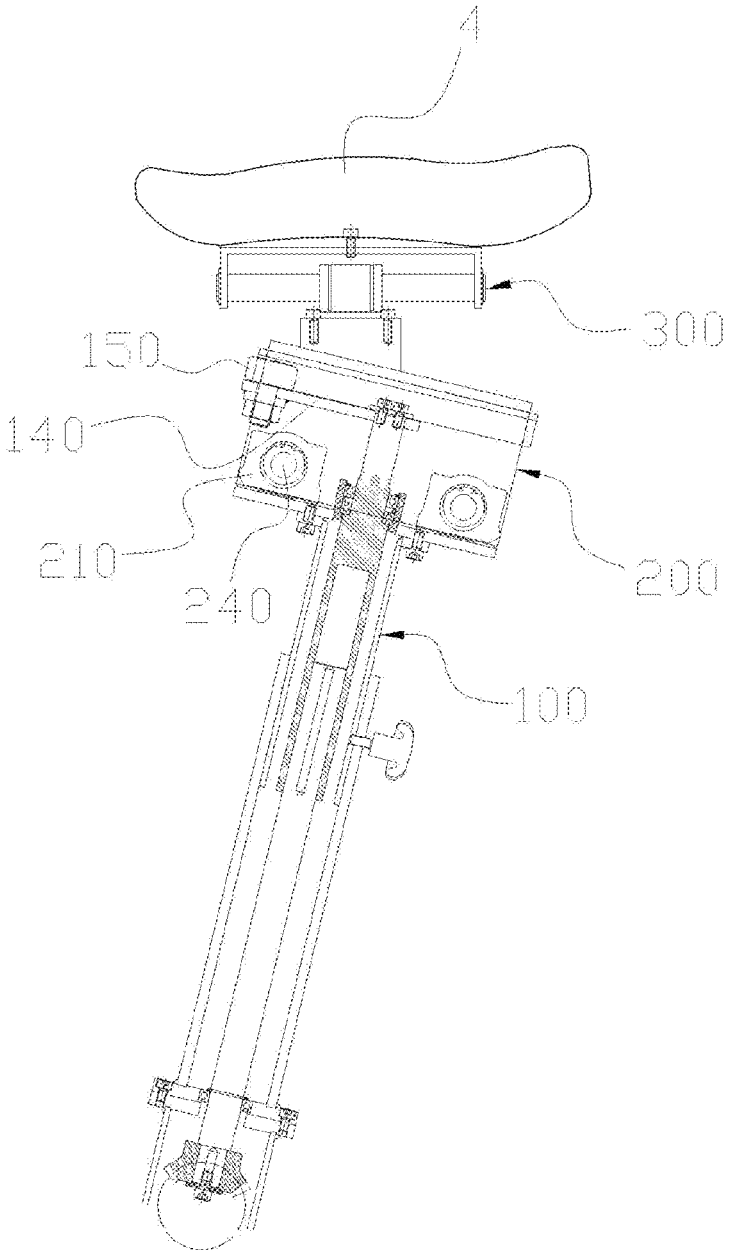
FIG. 5 is a cross sectional view illustrating the construction of a key part of the present invention.

FIG. 4 is a disassembled view of a preferred embodiment of the present invention, and FIG. 5 is a cross sectional view illustrating the major construction of the present invention.

As shown in the accompanying drawings, the operation part 100 of the present invention comprises; an oscillation body support 110 which has a hollow interior; a driving force transfer shaft 120 which is inserted into an inner space of the oscillation body support part for the driving force of the pedals to be transferred by arranging a worm gear at a lower side of the same;

A rotary shaft 130 which is positioned overlapped with the top of the driving force transfer shaft and rotates in sync with the driving force transfer shaft; a gyroscope 140 which is bolt-engaged in a perpendicular direction at the top of the rotary shaft; and a pressurizing protrusion 150 which is fixedly engaged at an end portion of the gyroscope.

The oscillation body support part 110 is an element allowing a smooth operation of the health bike 1 by supporting the users weight. As described above, the driving force transfer shaft 120 and the rotary shaft 130 are inserted into the inner space. It is preferred that the driving force transfer shaft 120 and the rotary shaft 130 are closely arranged, so the rotational force from the pedal 2 can be transferred to the rotary shaft 130 by means of the driving force transfer shaft 120 without any loss of the rotation force. For example, as shown in FIG. 4, a key groove 122 is formed in the vertical direction at the upper side of the driving force transfer shaft 120, and in a state that the keys (not shown) having different both surface areas are inserted, the driving force transfer shaft 120 is inserted into the inner space of the rotary shaft 130 (refer to FIG. 5), so as the driving force transfer shaft 120 moves toward the inner side of the rotary shaft 130 by means of the key having the oblique inclined surfaces, a tighter engagement can be maintained, so the driving force transfer shaft does not escape the rotary shaft 130 while making sure that the same rotations and operations can be maintained.

In addition, the gyroscope 140 has a 360° rotation range by means of the rotational driving of the rotary shaft 130, and the pressurizing protrusion 150 is fixed at the end portion of the gyroscope 140 and rotates in the same way for thereby varying the positions of the leftward and rightward driving part 120.

The leftward and rightward driving part 200 of the present invention comprises a rectangular frame shaped support housing 220 the bottom of which is open, a pair of guide shafts 240 arranged opposite to each other while crossing the sides from the inner side of the support housing, a ball bush 210 engaged to the guide shaft, a guide frame 250 engaged at the inner upper side of the support housing 220 in such a way to cross the guide shaft 240, and a bracket 230 for integrally engaging the forward and backward driving part 300 and the support housing 220.

The support housing 220 is provided to cover all the elements from the outside and is configured to position in leftward and rightward directions in such a way that the saddle 4 can oscillate in leftward and rightward direction.

Figure 6:
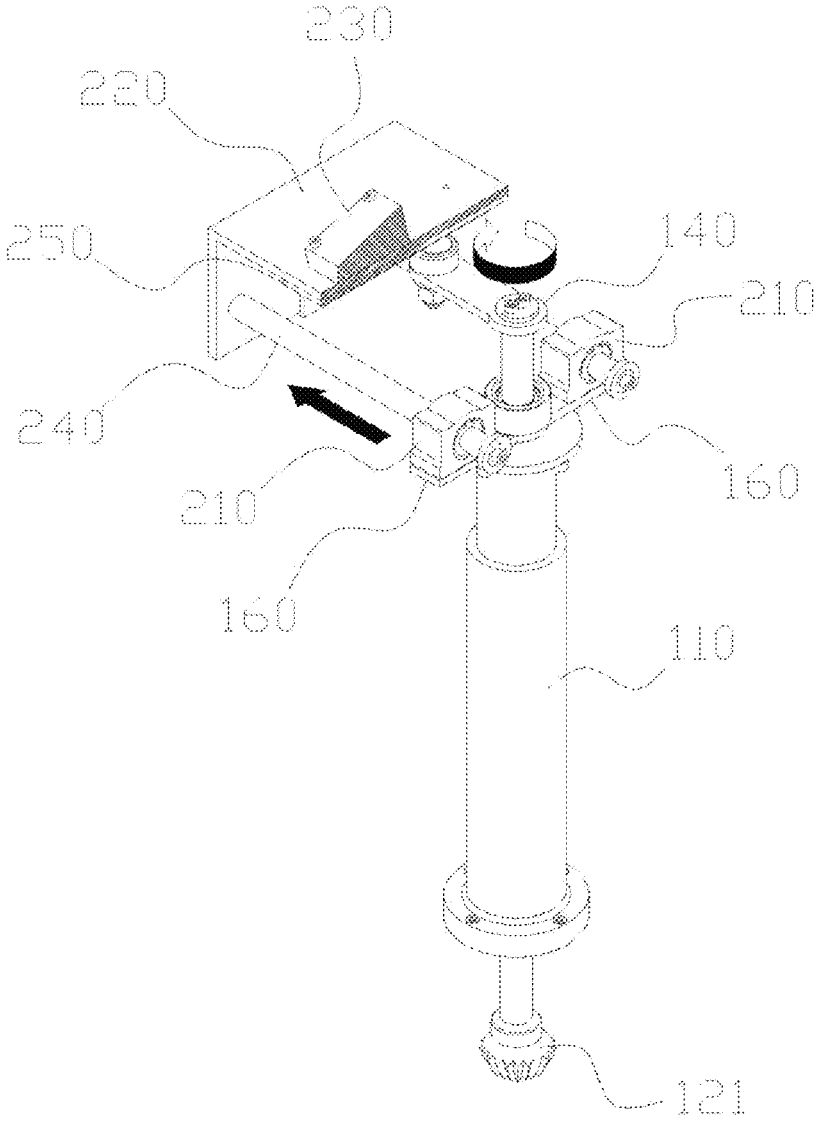
FIG. 6 is a view illustrating a use state while showing an operation that it can be driven in the leftward and rightward directions according to an embodiment of the present invention.

In more details, a plurality of fixing plates 160 are fixedly arranged at the upper side of the oscillation body support part 110 on the same line, and the ball bush 210 of the leftward and rightward driving part 200 is fixedly engaged at the fixing plate 160 so that the positions of the ball bush 210 engaged to the guide shaft 240 cannot change, and the pressurizing protrusion 150 of the operation part 100 is preferably engaged with the guide frame 250 provided at the leftward and rightward driving part 200. The pressurizing protrusion 150 pushes one side of the guide frame 250 with a constant pressure by means of the rotational operations of the rotary shaft 130 and gyroscope 140, and the support housing 220 changes its position about the ball bush 210 engaged to the guide shaft 240, so consequently the saddle 4 connected with the support housing 220 can change its position in the leftward and rightward directions (refer to FIG. 6). At this time, the pressurizing protrusion 150 held by the guide frame 250 can linearly reciprocate in the space provided by the guide frame.

The forward and backward driving part 300 of the present invention comprises guide shafts 240 opposite to each other in the longitudinal direction of the saddle 4, a support holder 310 accommodating the guide shaft and fixing both ends of the same, with the saddle 4 being mounted from the upper side, and a ball bush 210 engaged to the guide shaft 240 both ends of which are fixed.

The saddle 4 is mounted at the upper side of the support holder 310, and another guide shaft 240 is engaged with the ball bush 210 at the inner side for thereby obtaining a forward and backward motion of the saddle 4. The forward and backward driving part 300 of the present invention is configured to cover the elements from the outside like the support housing 220 of the leftward and rightward driving part 200 for thereby protecting it from any accidents from the outside while achieving a good look.

Figure 7:
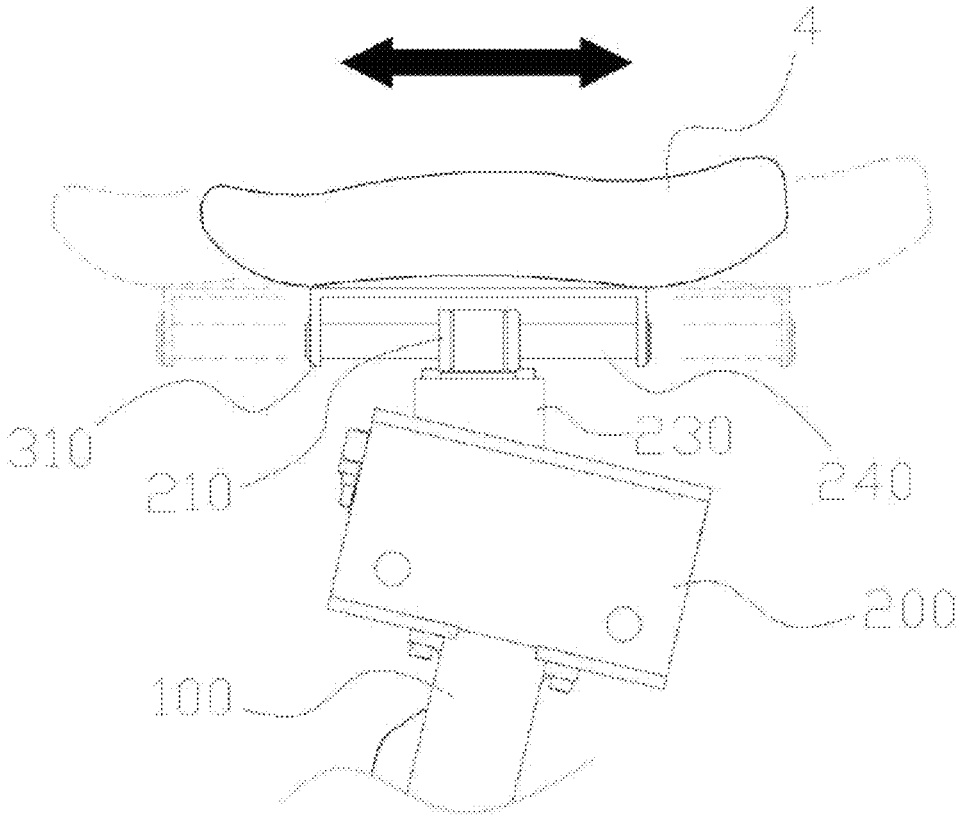
FIG. 7 is a view illustrating a use state while showing an operation that it can be driven in the forward and backward directions according to an embodiment of the present invention.

In other words, a pair of guide shafts 240 are provided opposite to each other at both ends of the support holder 310 integrally engaged with the support housing 220 by way of the bracket 230, and the guide shaft is provided in the longitudinal direction of the saddle 4 so that the saddle 4 can oscillate in forward and backward directions. A plate 340 is further provided at the bottom of the ball bush 210 for thereby directly fixing the plate with the bracket 230 for thereby preventing any motions of the ball bush. The ball bush 210 is not driven while it is being guided by the guide shaft 240, but the saddle position of the health bike 1 can change while the guide shaft 240 and the support holder 310 change its position about the fixed type ball bush 210 (refer to FIG. 7).

The above descried saddle structure of the present invention has features in that it can oscillates in the leftward, rightward, forward and backward directions while oscillating in all direction, which maximizes the effects of exercise. In particular, the above mentioned saddle covers all the elements from the outside for thereby obtaining an esthetic decoration effect, and when a user uses the instrument, it is possible to protect the user from any accidents.

The present invention has been described with the embodiments illustrated in the drawings, but it is provided for the illustrative purpose, and it is obvious that an ordinary person skilled in the art can modify in various forms within the equivalent ranges. So, the technical protection range of the present invention should be interpreted by the claims, and all the technical concepts in the equivalent ranges should be interpreted as being included in the scope of the right of the present invention.

Figure 8:
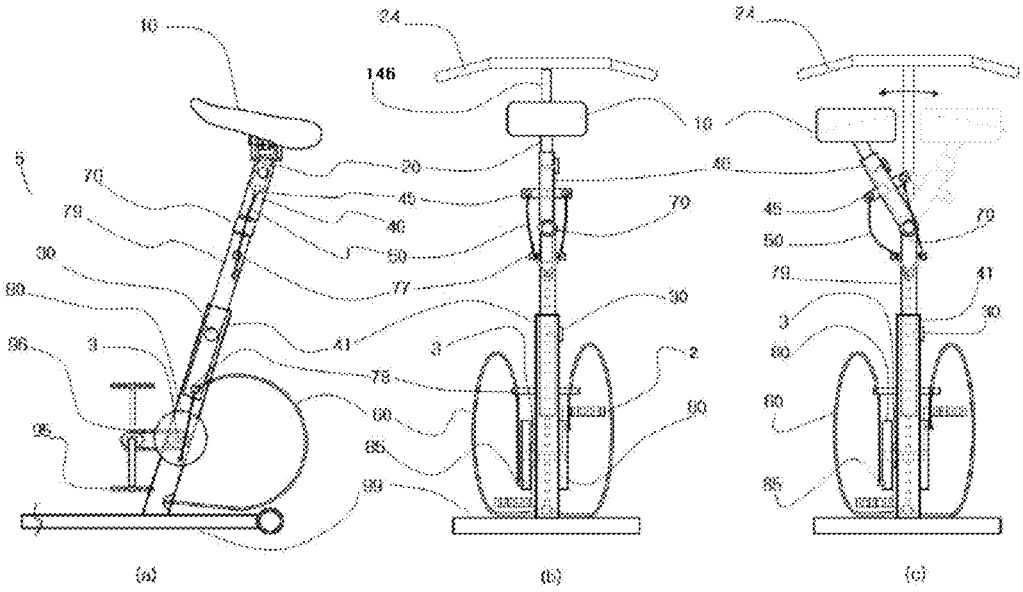
FIGS. 8*a*, 8*b* and 8*c* show the construction of a saddle of a health bike with a leftward and rightward oscillation saddle part 5 using a cable and a wire and a saddle part according to the present invention.
Figure 9:
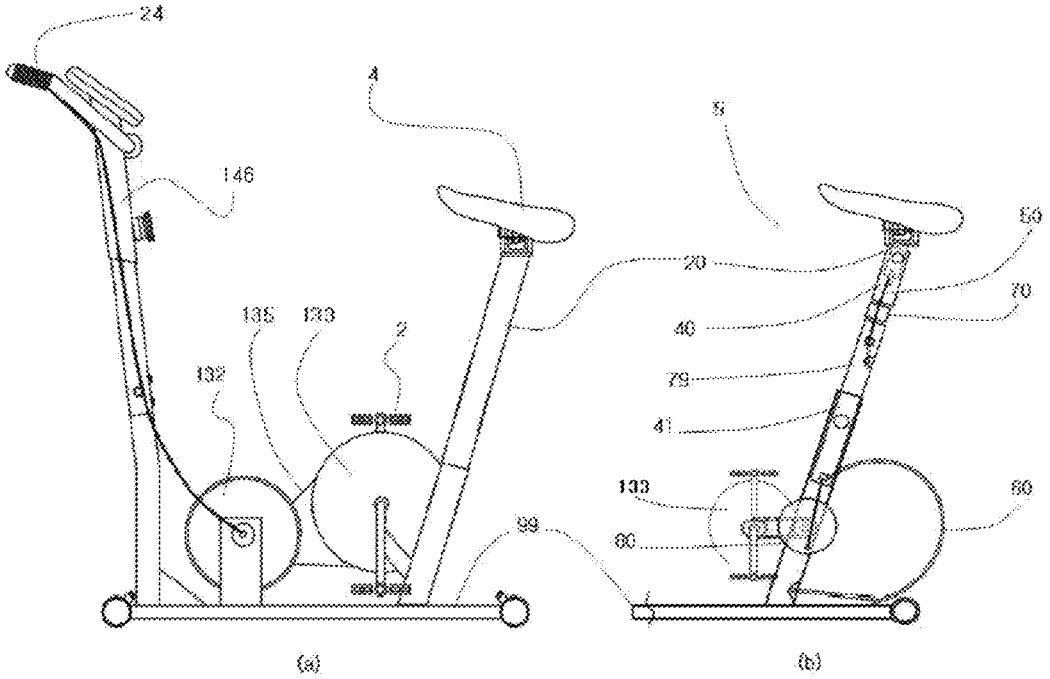
FIG. 9*a* is a side view of a conventional health bike.
FIG. 9*b* is a view illustrating the construction of a leftward and rightward oscillation saddle part 5 added to the construction of FIG. 9*a*.

FIG. 9*a* is a view of the conventional health bike which comprises a saddle 4, a handle bar 24 having a saddle part 20 and a handle and a head tube 146 supporting the handle bar 24. The user sits in the saddle and holds the handle bar 24 with both hands and pedals the pedal 2 provided at a lower side, so a driving force is transferred through the belt 135 provided at the outer side of the pedaling disk 133 rotating in sync with the rotation of the pedal 2, so the heavy flywheel 132 rotates for thereby performing a leg exercise. The saddle part 20 supporting the saddle of the conventional health bike is provided in an integrated form, and it is directly fixed at the support part 99; however in the present invention, the saddle part 20 is fixedly inserted into the saddle engaging part 40. When the user pedals the pedals, the saddle part engaging part 40, the saddle part 20 and the saddle 4 oscillate in leftward and rightward directions, and the saddle part 20 of the lower side of the saddle 4 of FIG. 8 is fixedly inserted into the saddle part engaging part 40, and a hinge 70 is provided between the saddle part engaging part 40 and the lower saddle part 79 for thereby oscillating the saddle part engaging part 40 in leftward and rightward directions.

The lower saddle part 79 is inserted into the saddle part support part 41 fixed at the support part 99 and is fixed with the fixing key 30, and the height of the saddle can be adjusted by adjusting the height of the lower saddle part 79 depending on the user's body condition. The cable 60 into which the wire 50 is introduced is used so as to convert the driving force of the pedaling into the driving force to be used for the sake of the leftward and rightward motions of the saddle part engaging part 40. One side of the cable 60 is fixed at the wire fixing roller 85 provided at one side surface of the cable disk 80 provided at both lower sides of the saddle part support part 41 of the wire 50, and the other end of the same is fixed at the wire clamp 45 provided at both sides of the saddle part engaging part 40, and the cable 60 is fixed at the cable clamp 1 (77) provided at both sides of the lower saddle part 79 and the cable clamp 2 (78) provided at both lower sides of the saddle part support part 41. When the rotational force from the cable disk 80 is transferred to the wire clamp 45, the connected wire 50 does not move.

Figure 10:
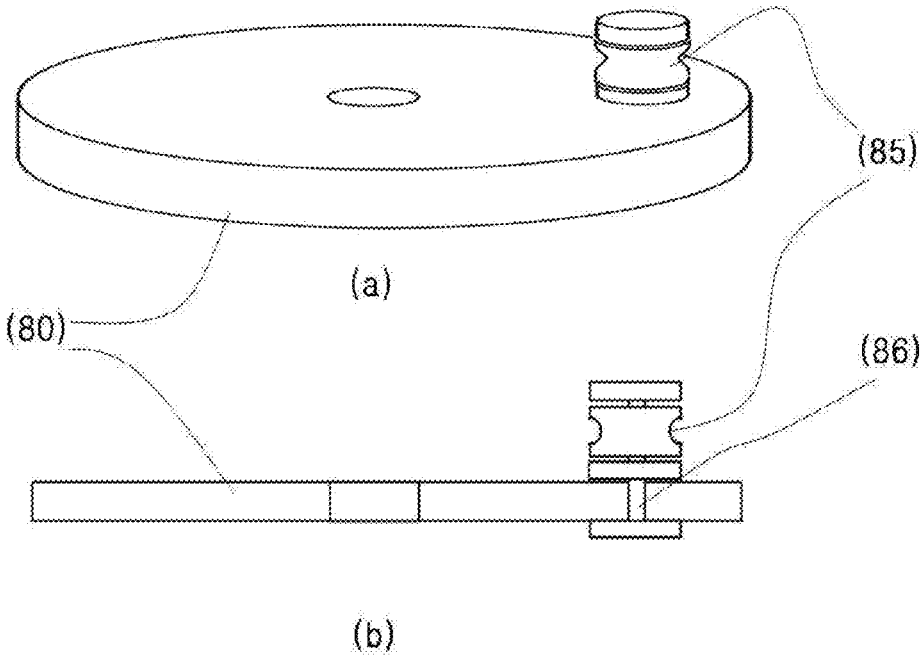
FIG. 10*a* is a perspective view of a rotatable wire fixing roller 85 provided at one side surface of the cable disk 80 and a wire fixing roller shaft 86.
FIG. 10*b* is a cross sectional view illustrating a cable disk.
Figure 11:
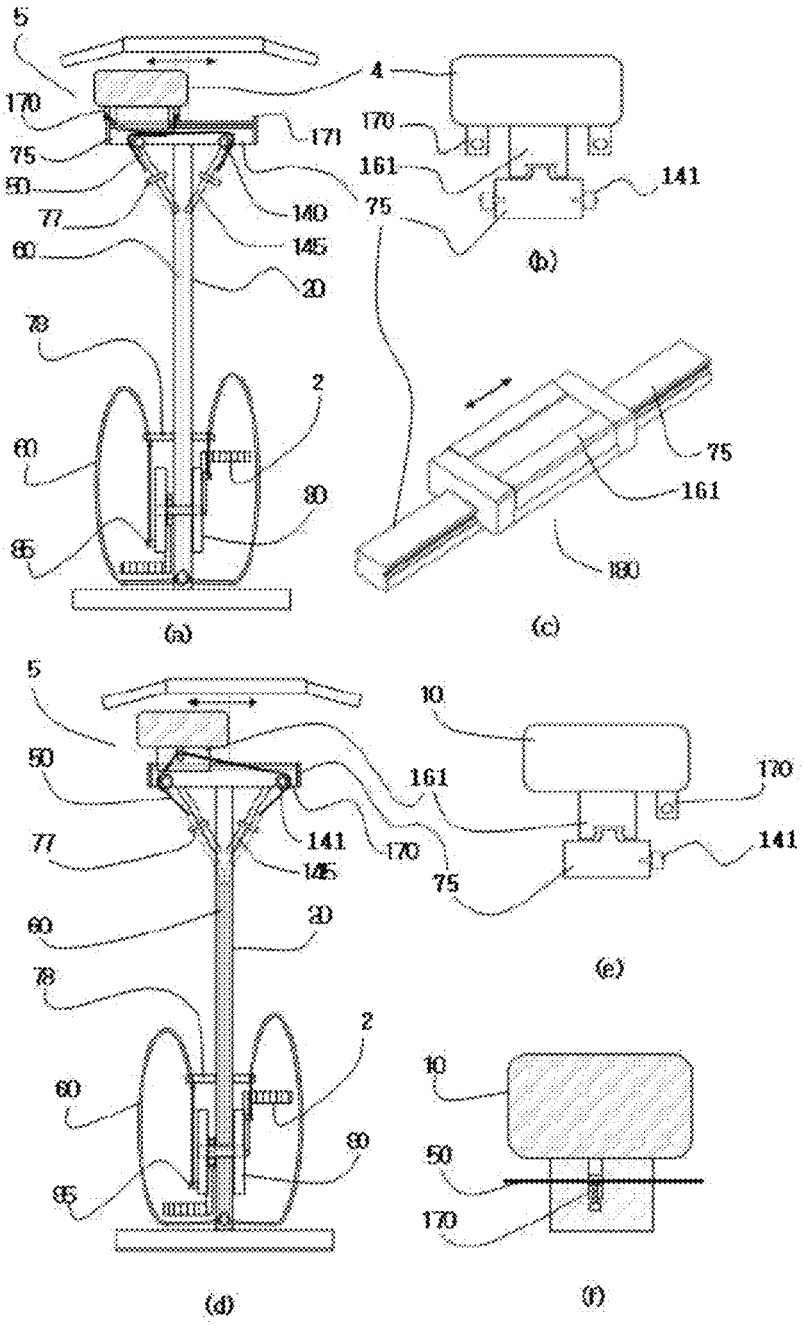
FIGS. 11*a* and 11*b* are views illustrating an example 1 in terms of the construction in which a leftward and rightward oscillation saddle part 5 is implemented with a cable, a wire and a LM guide 180 according to the present invention.
FIG. 11*c* is a perspective view illustrating a conventional LM guide.
FIGS. 11*d*, 11*e* and 11*f* are views illustrating an example 2 in terms of the construction in which a leftward and rightward oscillation saddle part 5 is implemented with a cable 60, a wire 50 and a LM guide 180.
Figure 12:
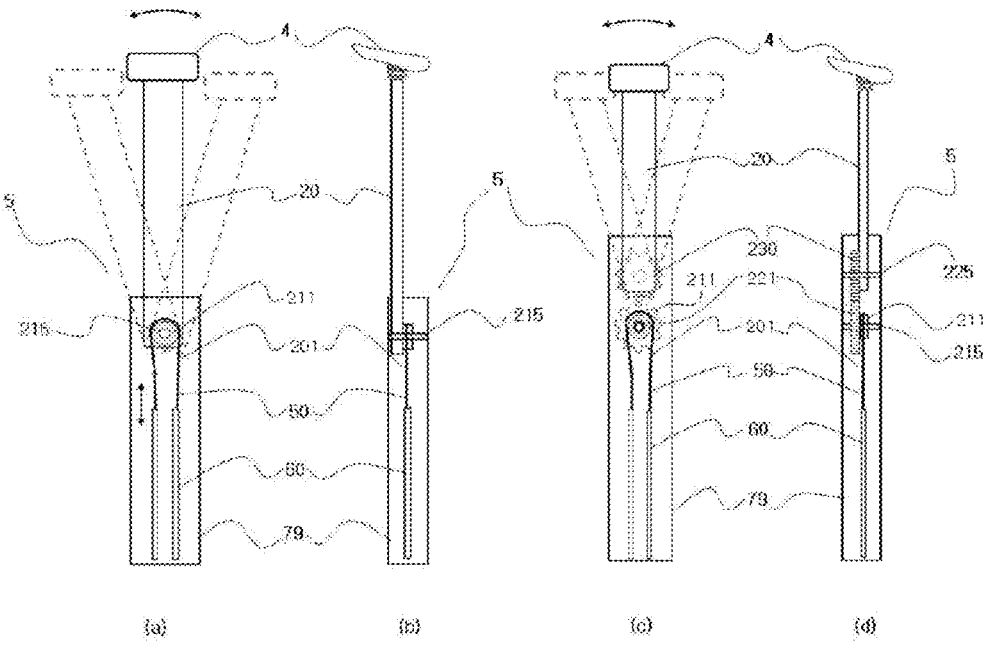
FIGS. 12*a* and 12*b* are views illustrating an example 3 in terms of the construction in which a leftward and rightward oscillation saddle part 5 is implemented with a cable, a wire, a pulley 210 and a driving force transfer belt 201.
FIGS. 12*c* and 12*d* are views illustrating an example 4 in terms of the construction in which a leftward and rightward saddle oscillation part is implemented with a cable, a wire, an upper gear and a lower gear.

The wire fixing roller 85 of the cable disk 80, the wire 50, the cable 60, the wire clamp 45, the cable clamp 1 (77) and the cable camp 2 (78) are provided at both sides of the lower saddle part 79 and the saddle part support part 41 in the same constructions, and as the driving force is transferred by way of the chain 96 by means of the pedaling, the sprocket 3 rotates. The cable disk 80 rotates on the same axis as the sprocket 3, and the wire 50 fixed at the wire fixing roller 85 of one side surface of each cable disk 80 provided at both sides of the saddle part support part 41 is tensioned or loosened in the reverse directions, and the saddle part engaging part 40, the saddle part 20 and the saddle 4 oscillate in the leftward and rightward directions about the hinge 70. At this time, the wire fixing roller 85 of the cable disk 80 of both sides rotates with an angle difference of 180° from each other. Since the wire fixing roller 85 provided at one side of the cable disk 80 of FIG. 10 can rotate 360° about the wire fixing roller shaft 86 acting as an axis, when the cable disk 80 of both sides rotates with an angle difference 180° as the pedals operate, the wire fixing roller 85 rotates in sync with the rotational angle, so the wire 50 connected with the wire fixing roller 85 is not twisted. The height of the saddle 4 can be adjusted by adjusting the length between the saddle part support part 41 and the lower saddle part 79. The lower saddle part 79 is inserted between the saddle part support parts 41 and is fixed at a certain height with a fixing key 30, so the height of the saddle can be easily adjusted depending on the user's physical condition. Here, the height of the lower saddle part 41 can be adjusted because the cable 60 is used as a driving force transfer means. In case of the fixed mechanical type, it is hard to adjust the height of the saddle; however when the cable 60 is used, the cable 60 is long enough within a certain range, so the height of the saddle 4 can be adjusted. FIGS. 11 and 12 are views illustrating four construction examples in which the leftward and rightward oscillation saddle part 5 is constructed by using the cable 60 into which the wire 50 is inserted, as a means of the driving force transfer for the sake of the leftward and rightward oscillations of the saddle. As shown in FIG. 11, what the cable 60 and the wire 50 are used as a driving force transfer part for the sake of the leftward and rightward oscillations of the saddle 4 is same as the present invention except that as a different feature, there is provided a sliding reciprocation structure in which the saddle can slide in leftward and rightward directions in such a way that a leftward and rightward sliding structure is obtained by using a LM guide 180 (linear motion guide) or a slide rail or a ball bush at the lower side of the saddle, and each wire 50 is tensioned or loosened in opposite directions depending on the rotation of the cable disk 80 of both sides. As shown in FIG. 11*c*, there is provided a slide 161 on the guide rail 75 of the lower side as the conventional LM guide 180, and a small ball bearing is provided along the guide rail 75 in the interior of the slide 161, so a friction force can be reduced by the use of the ball bearing when the slide 161 slides along the guide rail 75. As shown in FIGS. 11*a* and 11*b*, the structure of the lower side for the sake of the pedaling as the construction example 1 has features in that what the cable disk 80, the wire 50 and the cable 60 are used is the same as the present invention; however at the lower side of the saddle 4 is provided a LM guide 180 providing the leftward and rightward sliding of the saddle 4. The saddle 4 is fixed at the slide 161 of the lower side, and the lower side of the slide is inserted into the guide rail 75. As shown in FIG. 11*b*, the wire fixing part 170 is provided at both lower sides of the saddle 4 for the purpose of fixing the wire 50. The end of the wire 50 of the cable 60 connected to the cable disk 80 of both lower sides of the saddle part 20 is crossed past the roller 141 and is fixed at the wire fixing part 170 of the opposite side, and each wire 50 can be tensioned and loosened in the opposite directions during the pedaling for thereby oscillating the saddle in leftward and rightward directions. The rail support part 145 is provided at both sides between the guide ail 75 and the saddle part 20 of the lower side of the guide rail 75 for thereby obtaining a mechanical strength, and each cable is fixed at the cable clamp 1 (77) of the rail support part 145. A roller 141 is provided at both sides of the guide rail 75. FIGS. 11*d*, 11*e* and 11 f show the construction example 2 of the leftward and rightward oscillation saddle part 5 by using a cable 60 with a wire 50 and a LM guide 180. Like the construction shown in FIGS. 11*a* and 11*b*, the driving force is transferred using the wire 50 and the LM guide 180 is provided at the lower side of the saddle 4; however different in this construction, only wire fixing part 170 is provided at the lower side of the saddle 4, and both wires 50 are fixed together at the wire fixing part 170 or the wire 50 is fixed at the wire fixing part 170 by using the integrated wire 50, so the saddle 4 can oscillate in leftward and rightward directions depending on the leftward and rightward reciprocation motions of the wire 50 according to the pedaling. FIGS. 12*a* and 12*b* show the construction example 3 having features in another type of a leftward and rightward oscillation saddle part 5 without a LM guide 180. There are provided a pulley 210 provided at an inner upper side of the lower saddle part 79 and a leftward and rightward oscillation structure of the saddle 4 having a saddle part 20 which can perform a leftward and rightward oscillation at a certain angle as it is fixed at the pulley 210. A driving force transfer belt 201 is connected to both ends of the wire 50, respectively, so the wire 50 is tensioned and loosened in the opposite directions, whereby the pulley 210 on which the driving force transfer belt 201 is wound can reciprocate at a certain angle in the clockwise and counterclockwise directions. Here, the pulley 210 is fixed at the lower side of the saddle part 20 and is engaged to the lower saddle part 79 as a shaft 215. At this time, a protrusion structure is formed on the surfaces of the driving force transfer belt 201 and the pulley 210 for thereby enhancing a friction force and preventing a slippery. FIGS. 12*c* and 12*d* show the construction example 4 having features in that the gear is adapted instead the pulley 210. Like the construction shown in FIGS. 12*a* and 12*b*, when the driving force transfer belt 201 rotates a certain angle by the pedaling, the lower gear 221 which is together fixed and rotates transfers a rotational force to the upper gear 230, and the saddle part 20 which is fixed at the upper gear 230 and rotates together reciprocates at a certain angle, so the oscillation structure of the saddle 4 having features in the upper shaft 225 works as an axis can be obtained. As described in the present invention and the four construction examples, when the rotational force from the pedaling is transferred to the cable disk 80 by way of the chain 96, the wire 50 connected to each wire fixing roller 85 of the cable disk 80 provided at both sides rotates with an angle difference of 180°, and each wire 50 is tensioned and loosened in the opposite directions, the operations of which are adapted to the leftward and rightward oscillation saddle part 5 for thereby obtaining various constructions while making sure that the height of the saddle can be easily adjusted. As the driving force is transferred to the leftward and rightward oscillation saddle part 5 by using the cable disk 80 and the wire 50, the height of the saddle can be also adjusted. It is obvious that the simple modification and application on the leftward and rightward oscillation saddle structure of the health bike saddle 4 belongs to the range of the present invention.

Figure 13:
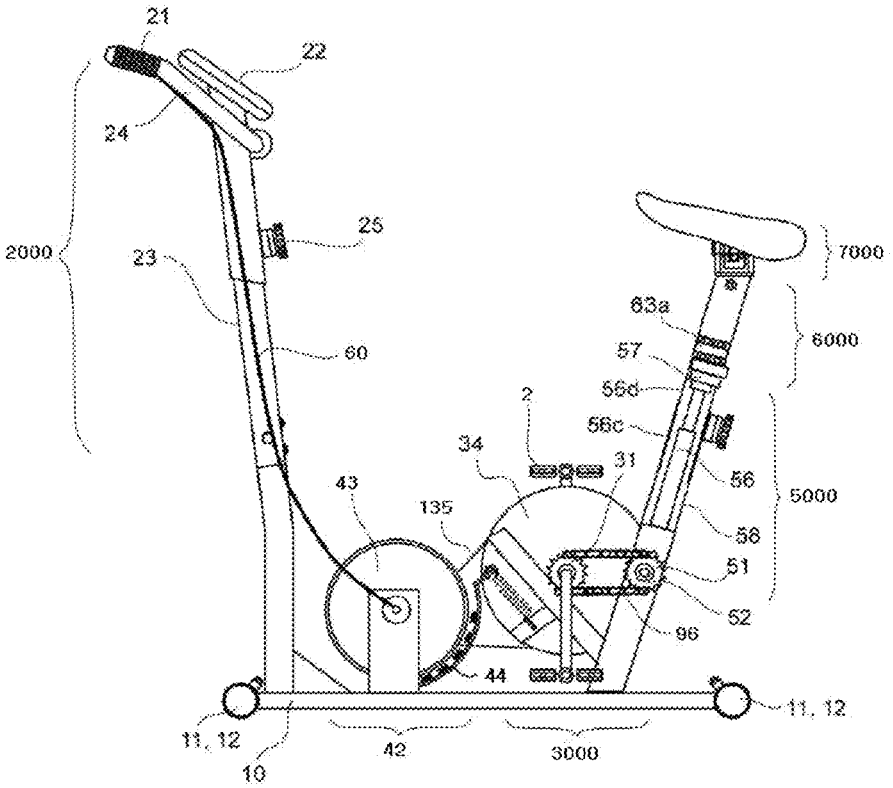
FIG. 13 is a side view of a health bike with an oscillation saddle according to an embodiment of the present invention.

FIG. 13 is a side view illustrating a health bike with an oscillation saddle according to the present invention. As shown in FIG. 13, the present invention comprises a base frame 10 supporting and fixing the exercise instrument, a handle part 2000 fixed at the base frame 10, a pedal part 3000 for a user to do exercises while the user pedals with his feet thereon, a rotational torque adjusting mean 42 engaged to the pedal part 3000 and adjusting the rotational torque of the pedal part 3000, an oscillation instrument 5000 receiving a rotational motion of the pedal part 3000 and performing an eccentric motion, and an oscillation adjusting part 6000 converting the motion of the saddle part 7000 into a leftward and rightward oscillation motion using the eccentric motion of the oscillation instrument 5000 and adjusting the leftward and rightward oscillation motion width.

As shown in FIG. 13, the base frame 10 is formed in a H shape made from a rectangular or circular aluminum pipe and comprises a main frame 11 at the center. The support frame 12 is welded at both ends of the main frame 11, and on the top of the main frame 11 are vertically welded the handle part 2000, the pedal part 3000, the rotation torque adjusting mean 42 and the oscillation instrument 5000.

At both ends of each support frame 2 of the base frame 10 is engaged a horizontal adjusting part (not shown) of a typical screw adjusting method for the sake of a stable installation when the bottom is not even. In addition, a vibration absorption plate (not shown) such as a rubber elastic plate, etc. is provided at the bottom contact portion of the height adjusting part for thereby absorbing the vibrations and impact energy generating when the user's oscillation motions influence the bottom.

As shown in FIG. 13, the handle part 2000 comprises a handle support part 23 which is vertically welded at a front side of the main frame 11 and has a height adjusting part 25 and is made from a rectangular aluminum pipe material, an indicator part 22 engaged at the top of the handle support part 23, a handle bar 24 attached to both sides of the indicator part 22, and a handle 21 which is made from an elastic material and is disposed at the ends of the handle bar 24. The height adjusting part 25 of the handle part 2000 is configured in such a way that the height of the same can be adjusted upwards and downwards depending on the user's physical conditions with the operation of the screw handle of the height adjusting part 25 engaged at an outer pipe of the handle support part 23 made in a double pipe slide structure.

Figure 14:
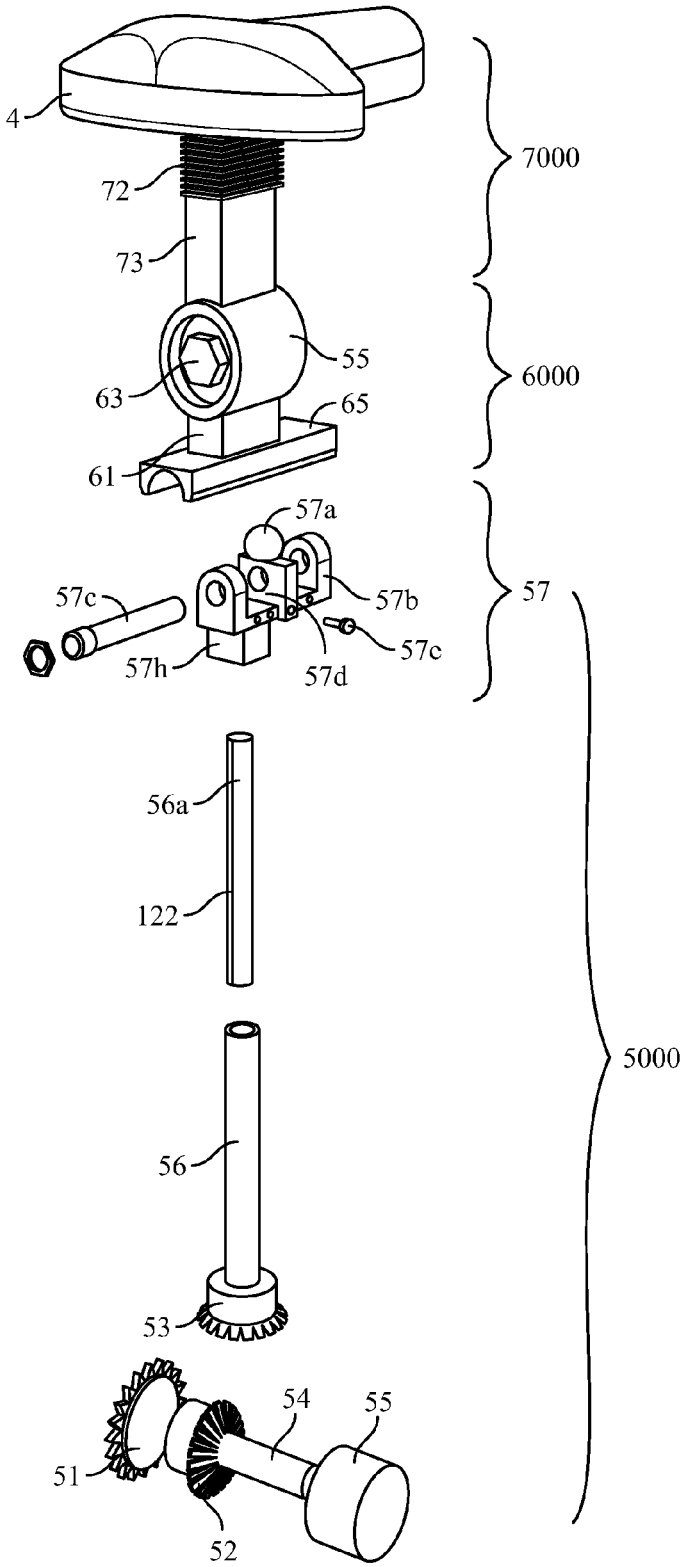
FIG. 14 is a disassembled perspective view illustrating an oscillation apparatus according to an embodiment of the present invention.

Referring to FIGS. 13 and 14, the saddle part 7000 and the oscillation adjusting part 6000 will be described. The saddle part. 7000 comprises a saddle 4 in which a user sits, a saddle hinge 72 provided at the lower side of the saddle 4 so as to help keep upright the user's upper body when the user's waist swings leftwards and rightwards and a saddle support part 73 which is engaged with the saddle hinge 72 and is made from a rectangular or circular aluminum pipe. The saddle support part 73 is integrally welded at the top of the bearing and bearing housing 55 of the oscillation adjusting part 6000 by means of a means such as a welding, etc.

As shown in FIG. 13, the pedal part 3000 integrally comprises a crank pedal 2 on which a user pedals downwards for the sake of a cycling exercise with his feet on the same, a driving sprocket 31 rotating in sync with the cycling motion of the pedals 2, and a driving pulley 34.

The driving pulley 34 rotating in integral engagement with the pedal part 3000 comprises a driven pulley (not shown) with a certain diameter connected with the driving belt 135 and receiving a rotational motion, and a rotation drum 43 with a large diameter being integral with the driven pulley and having a certain friction surface on an outer surface for thereby adjusting the load of the exercise by adjusting the rotation torque.

The rotation torque adjusting mean 42 is configured to adjust the exercise level of the user in such a way to raise or lower the rotational torque of the driving pulley 34 by limiting the driving pulley 34 of the pedal part 3000 as the tension can be changed by adjusting the distance of the connected cable 60 with a rotational operation of the handle 21 with respect to the contact strength of the friction pad 44 surrounding the outer surface of the rotation drum 43 which is driven integrally with the driven pulley.

In addition, the driving sprocket 31 rotating in integral engagement with the crank of the pedal 2 of the pedal part 3000 is connected with the driving chain 96 and transfers a rotational motion to the driven sprocket 51 of the oscillation instrument 5000.

FIG. 14 is a view illustrating the oscillation instrument 5000, the eccentric adjusting part 57, the oscillation adjusting part 6000 and the saddle part 7000 according to the present invention. When the horizontal rotational motion of the driving sprocket 31 of the pedal part 3000 is transferred to the driven sprocket 51 through the driving chain 96, the oscillation instrument 5000 converts the horizontal rotation motion into a vertical rotation motion, and the vertical rotation motion causes the positions of the eccentric part 57*b*, the oscillation adjusting part 57, the adjuster 57*d* engaged to the eccentric part 57*b* and the spherical roller 57*a* integrally engaged to the adjuster 57*d* to move horizontally for hereby adjusting the oscillation width (angle).

The driven sprocket 51 of the oscillation instrument 5000 is inserted into the bearing and bearing housing 55 which provides free rotations and is engaged to the horizontal shaft 54 along with the horizontal rotation bevel gear 52 for the sake of a free motion. In order to convert the horizontal rotation motion of the driven sprocket 51 into a vertical rotation motion, it is engaged with the teeth of the horizontal rotation bevel gear 52 and the vertical rotation bevel gear 53, respectively. The vertical rotation bevel gear 53 is fixedly engaged with the external vertical shaft 56, and the internal vertical shaft 56*a* is inserted into the external vertical shaft 56 in a sliding structure, so it can be extendable in the upward and downward directions during the adjustment of the height of the saddle part 7000. In addition, the internal vertical shaft 56*a* and the external vertical shaft 56 are fixedly supported at a lower extendable frame 56*c* and an upper extendable frame 56*b* by way of the bearing (not shown), so they can freely move in upward and downward directions during the adjustment of the height of the saddle part 7000 and can freely rotate.

A key groove (not shown) is longitudinally formed in the axial direction in the interior of the external vertical shaft 56 for the external vertical shaft 56 and the internal vertical shaft 56*a* to transfer a rotational motion as they extend and contract depending on the adjustment of the height of the saddle part 7000 for the purpose of transferring rotational motions. On the surface of the internal vertical shaft 56*a* is formed a protrusion (not show) which is inserted into the key groove 56*b* and can smoothly move in the upward and downward directions and can rotate. The key groove 56*b* is not limited to the internal vertical shaft 56*a*, and the protrusion (no shown) is not limited to the external vertical shaft 56, and the key groove 56*b* and the protrusion might be provided at opposite portions.

The upper end of the internal vertical shaft 56*a* is inserted into the engaging port (not shown) formed at the vertical rotary shaft 57*h* of the lower side of the eccentric adjusting part 57 and is fixed by a bolt (now shown).

The internal rotary shaft 56*a* of the oscillation instrument 5000 is engaged to the vertical rotary shaft 57*h* of the lower side of the eccentric adjusting part 57, and the vertical rotary shaft 57*h* fixedly engaged at the internal vertical shaft 56*a* performs a circular movement about the vertical rotary shaft 57*h* with respect to the whole portions of the eccentric adjusting part 57 such as the spherical roller 57*a* integrally engaged with the eccentric part 57*b*.

Figure 16:
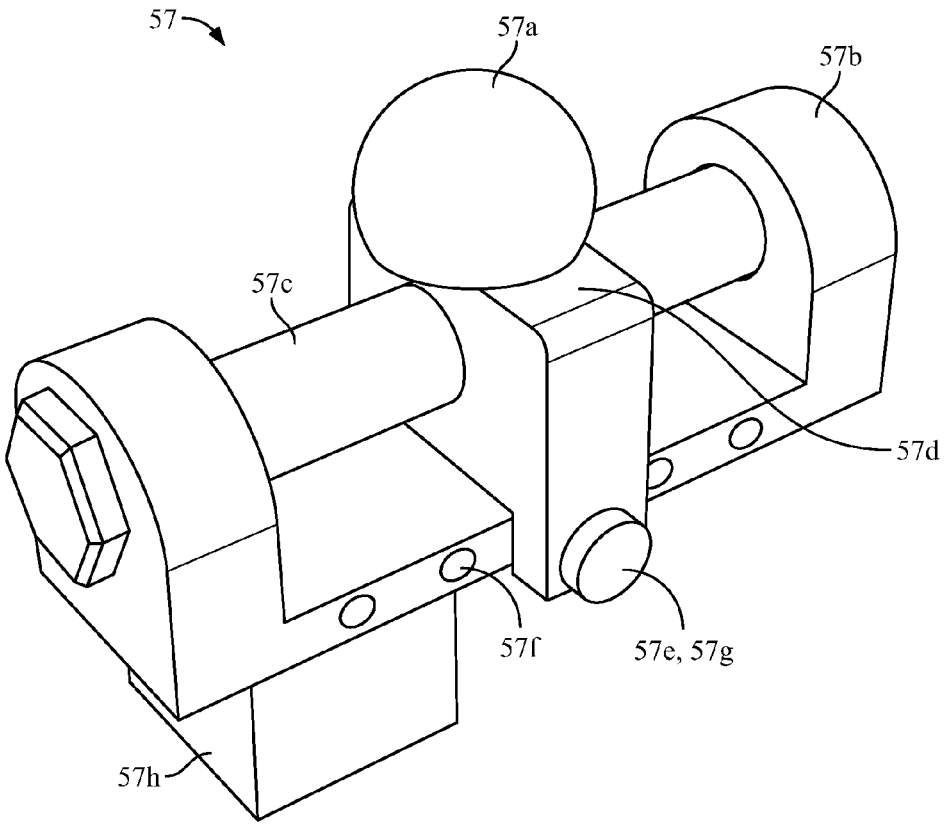
FIG. 16 is an enlarged view illustrating an eccentric disk of an oscillation apparatus according to an embodiment of the present invention.

As shown in FIG. 16, the eccentric adjusting part 57 comprises a spherical roller 57*a*, an adjuster 57*d* integrally engaged at the lower side of the spherical roller 57*a* for thereby changing the eccentric positions of the spherical roller 57*a*, a fixing pin insertion hole 57*g* and a fixing pin 57*e* provided at the lower side of one side of the adjuster 57*d* for the purpose of fixing the adjuster 57*d* at a specific position, an eccentric part horizontal shaft 57*c* passing through the adjuster 57*d*, an eccentric part 57*b* fixing the eccentric part horizontal shaft 57*c*, an eccentric adjusting hole 57*f* formed at a side surface of the bottom of the eccentric part 57*b*, and a vertical rotary shaft 57*h* formed at one lower side of the eccentric part 57*b* for thereby engaging and fixing the internal vertical shaft 56*a*.

The oscillation adjusting part 6000 comprises a bearing and bearing housing 55 engaged to the saddle support part 73 and an oscillation transfer part 61 and an oscillation link part 65 integrally disposed at the lower side of the bearing and bearing housing 55. Here, the bearing and bearing housing 55 is engaged with the saddle support part 73 at its upper side and is engaged with the oscillation transfer part 61 at its lower side for thereby playing as a fixing point which corresponds to the force-concentrating point of the leftward and rightward oscillation motions of the saddle part 7000. In addition, the bearings each formed of the bearing and beating housing 55 are provided in multiple numbers, which guarantee the oscillation motions, and the saddle part 7000 can be stably supported.

Into the lower cross section surface of the oscillation link part 65 is inserted the spherical roller 57*a* of the eccentric adjusting part 57 in a semispherical shape by which it can freely move in the horizontal directions. When the spherical roller 57*a* moves in a circular shape at the fixed position of the eccentric part 57*b*, the oscillation link part 65 inserted into the lower side of the spherical roller 57*a* oscillates in the leftward and rightward directions about the oscillation shaft 63 of the bearing and bearing housing 55 as a fixed point. The width of the leftward and rightward oscillation motion, i.e. the change in the oscillation angle can be obtained by adjusting the distance of the adjuster 57*d* from the center of the vertical rotational shaft 57*h* of the spherical roller 57*a*. The oscillation angle becomes zero (0) at the point where the position of the adjuster 57*d* matches with the vertical rotary shaft 57*h*, and the oscillation angle increases as the position of the adjuster 57*d* becomes farther from the center of the vertical rotary shaft 57*h*.

When it is needed to adjust the position of the adjuster 57*d*, the fixing pin 57*e* inserted in the fixing pin insertion hole 57*g* of the lower side of the lateral surface of the adjuster 57*d* of the eccentric adjusting part 57 is pulled out, and the adjuster 57*d* is moved to a desired position along the eccentric horizontal shaft 57*c*, and then the fixing pin 57*e* is inserted and fixed at the position matching with the eccentric adjusting hole 57*f* formed at the lower side surface of the eccentric part 57*b*. The fixing pin 57*e* is made from a magnetic material which generates magnetic force, and at the opposite side of the eccentric adjusting hole 57*f* into which the fixing pin 57*e* is inserted is fixed a ferrite metallic piece, so the insertion and escape of the fixing pin 57*e* can be performed without using a certain tool, which makes the user to easily adjust the oscillation angle of the saddle. If a certain means can be provided for the sake of the insertion and escape of the fixing pin 57*e*, it does not need to limit using the magnetic fixing pin 57*e*.

The leftward and rightward oscillation motions of the oscillation instrument 5000 has features in that the driving ratio of the driven sprocket 51 receiving a horizontal driving force of the driving sprocket 31 of the pedal part 3000 is 1:1, and the driving ratio of the bevel gears 52 and 53 of the vertical and horizontal rotations converting the horizontal rotation motions of the driven sprocket 51 into the vertical rotation motions is 1:1, so the leftward and rightward maximum oscillation angles of the saddle 4 are matched with the top dead point and the bottom dead point of the crank as the pedals operate in sync with the rotational motions.

Figure 15A:
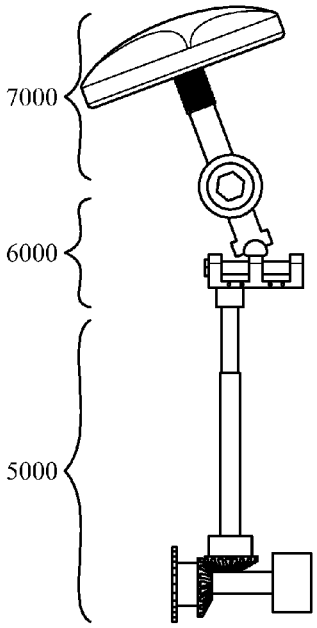
FIG. 15 is a perspective view illustrating a leftward and rightward oscillation state according to an embodiment of the present invention.
Figure 15B:
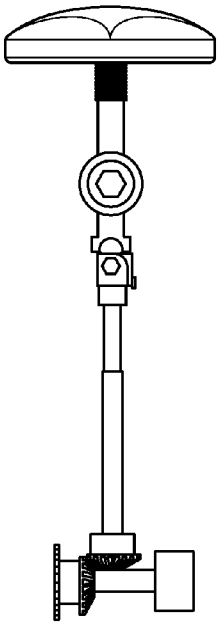
Figure 15C:
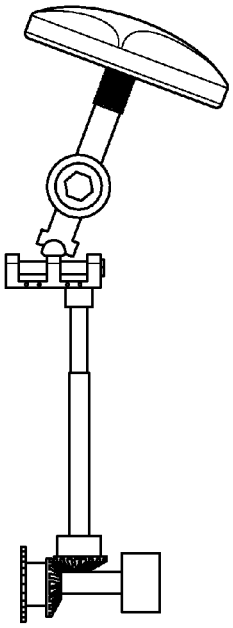

(1) of FIG. 15 shows a state that the saddle 4 is inclined with the maximum oscillation angle in the leftward direction when the left pedal is positioned at the bottom dead point, and the right pedal is positioned at the top dead point, and (2) of FIG. 15 shows a state that the saddle 4 is positioned at the center when the left and right pedals have reached the horizontal states while indicating 3-hour and 9-hour positions, respectively. (3) of FIG. 15*shows* a state that the saddle 4 is inclined with the maximum oscillation angle in the rightward direction when the right pedal is positioned at the bottom dead point, and the left pedal is positioned at the top dead point.

The present invention is directed to providing a health bike with a leftward and rightward oscillation saddle apparatus which can maximize the effects of exercises, and has features in that the leftward and rightward oscillation apparatus of the saddle is formed of a LM guide (Linear Motion guide) so as to secure stability and minimize the vibrations occurring due to the horizontal oscillations when the saddle oscillates in leftward and rightward directions or the linear bush is used as a leftward and rightward oscillation apparatus, so in terms of the driving force of the leftward and rightward oscillation apparatus, the rotational motions are generated and transferred in combination with the sprocket, the chain and the bevel gears by using the driving force of the pedals. The thusly generated rotational motion is converted into the leftward and rightward oscillation reciprocation motions with the aid of the leftward and rightward oscillation apparatus of the saddle. The basic construction of the present invention comprises, by their stages, a driving force generation part S1, a driving force transfer part S2, a leftward and rightward oscillation apparatus part 1 (S3) or a leftward and rightward oscillation apparatus part 2 (S4) and a health bike apparatus part S5.

Figure 17:
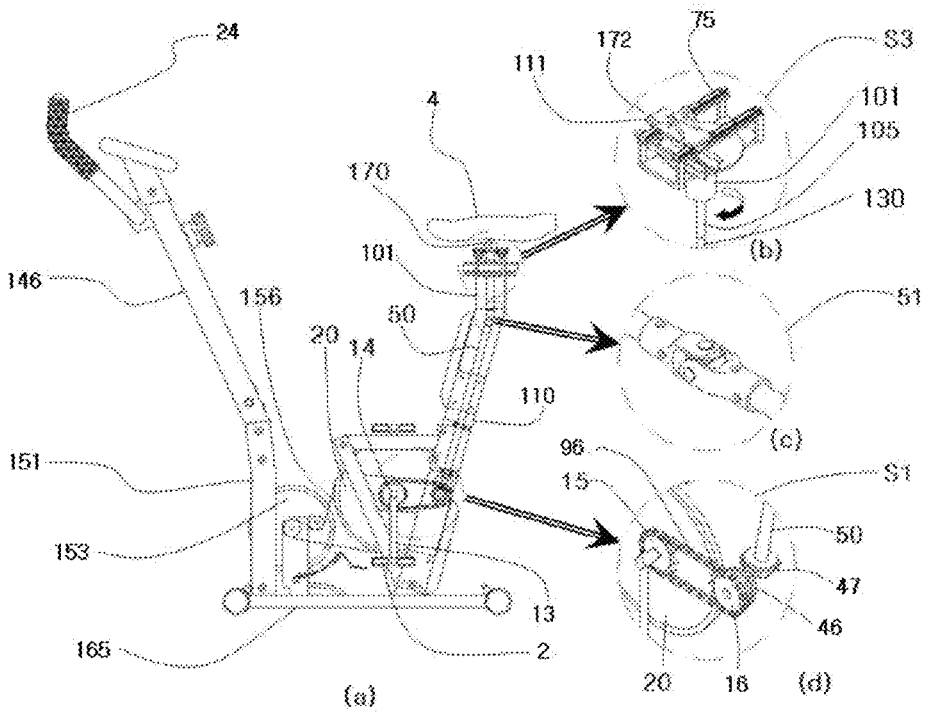
FIG. 17*a* is a view of a health bike with a leftward and rightward oscillation saddle part.
FIG. 17*b* is a view of a partially enlarged perspective view illustrating a leftward and rightward oscillation apparatus part 1 (S3).
FIG. 17*c* is a partially enlarged perspective view illustrating a universal joint.
FIG. 17*d* is a partially enlarged perspective view illustrating a driving force generation part (S1) and a driving force transfer bevel gears 1 and 2.

As shown in FIG. 17, the driving force generation part S1 is formed of pedals 2, a crank arm 13, a sprocket 1 (15) and a pedaling disk 131. As the user applies forces to the pedals, a rotational force is generated in proportion to the length of the crank arm 13 about the crank rotary shaft 14 of the pedals 2. At the crank rotary shaft 14 is provided a pedaling disk 131 for the purpose of supplying a driving force to the sprocket 1 (15) and the flywheel 132, so they are configured to rotate together.

Figure 18:
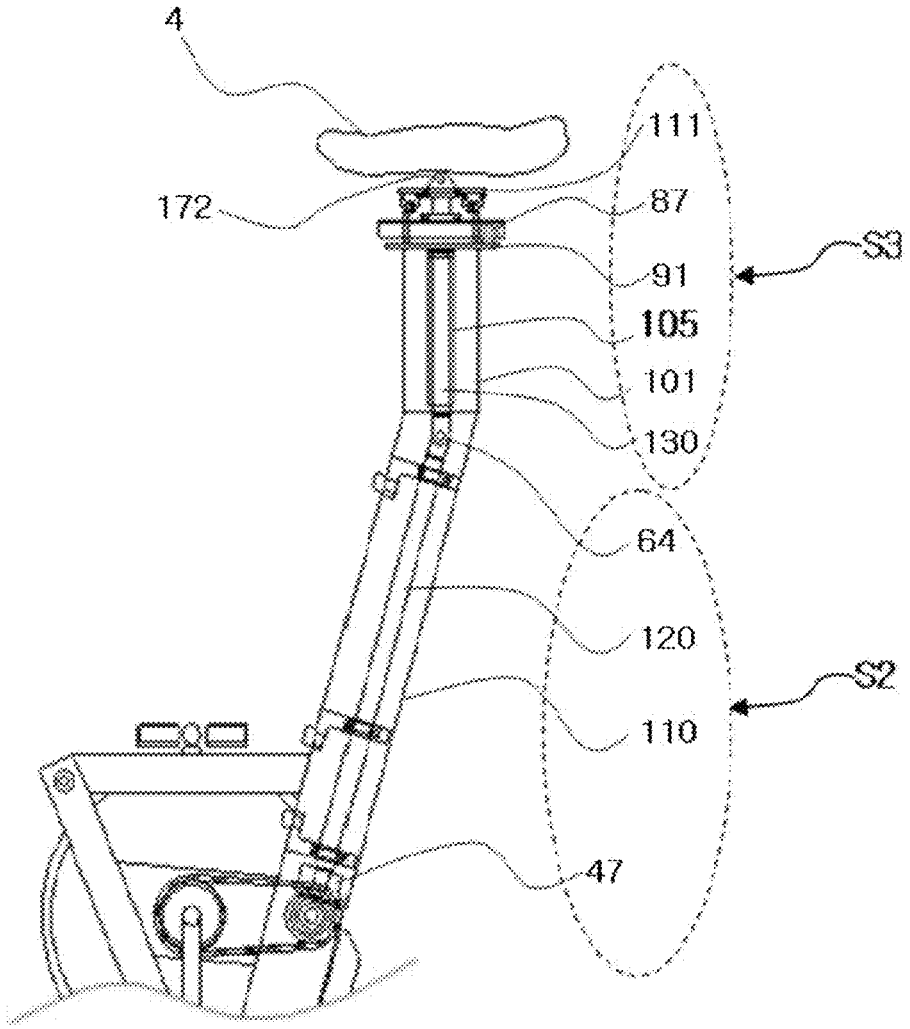
FIG. 18 is a partially enlarged view of a driving force transfer part (S2) and a leftward and rightward oscillation apparatus part 1(S3).

As shown in FIGS. 17 and 18, the driving force transfer part S2 comprises a chain 96, a sprocket 2 (16), a bevel gear 1 (46), a bevel gear 2 (47), a driving force transfer shaft 120 and a universal joint 64. The driving force is transferred from the driving force generation part S1 to the leftward and rightward oscillation apparatus part 1 (S3). The sprocket 1 (15) and the sprocket 2 (16) are engaged through a gear or a chain 96, so the rotational force of the sprocket 1 (15) is transferred to the sprocket 2 (16) provided at the oscillation body support part 110, and the bevel gear 1 (46) is engaged on the same axis as the sprocket 2 (16), so they rotate together, and the bevel gear 2 (47) is engaged at the bevel gear 1 (46) in the vertical direction, so they rotate together. The driving force transfer shaft 120 is connected in the direction of the rotary shaft of the bevel gear 2 (47), and at the other end of the driving force transfer shaft is provided a universal joint 64.

Figure 19:
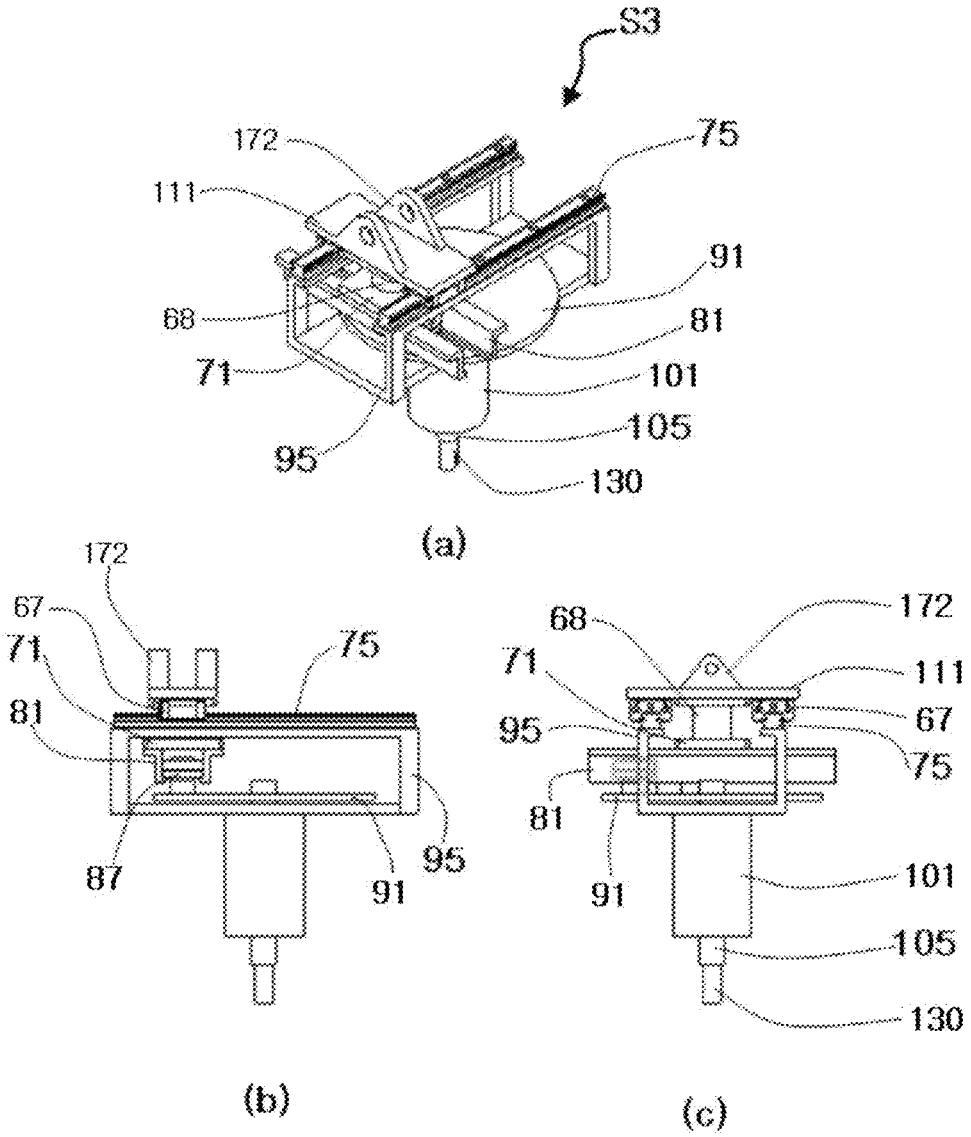
FIG. 19*a* is a perspective view illustrating a leftward and rightward oscillation apparatus part 1(S3).
FIG. 19*b* is a side view illustrating a leftward and rightward oscillation apparatus part 1(S3).
FIG. 19*c* is a front view illustrating a leftward and rightward oscillation apparatus part 1(S3).
Figure 20A:
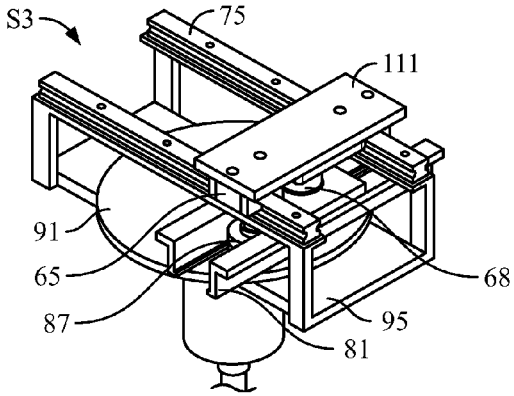
FIGS. 20*a* to 20*f* are flow charts illustrating the procedures that the rotational force from the leftward and rightward oscillation apparatus part 1(S3) is converted into a leftward and rightward reciprocation motion.
Figure 20B:
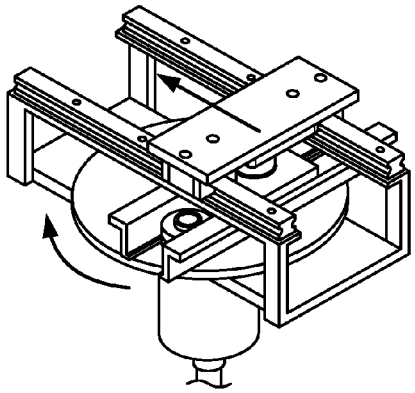
Figure 20C:
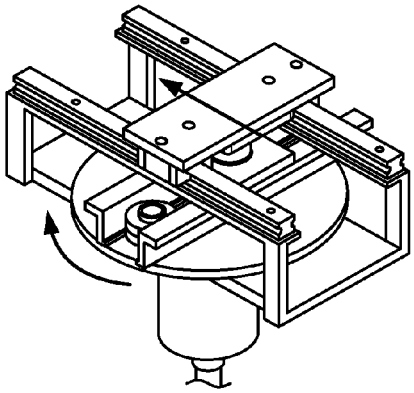
Figure 20D:
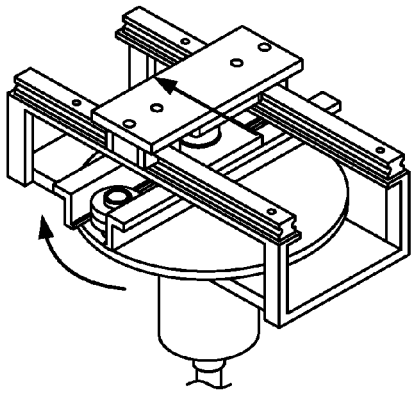
Figure 20E:
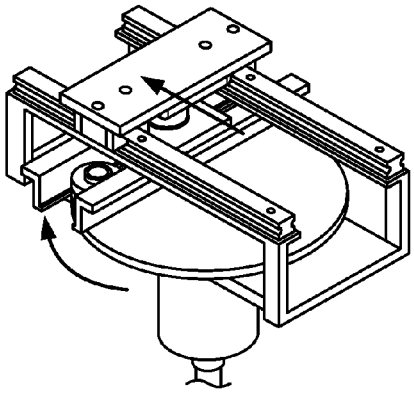
Figure 20F:
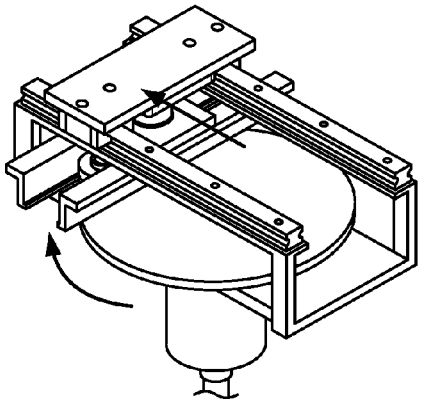
Figure 21:
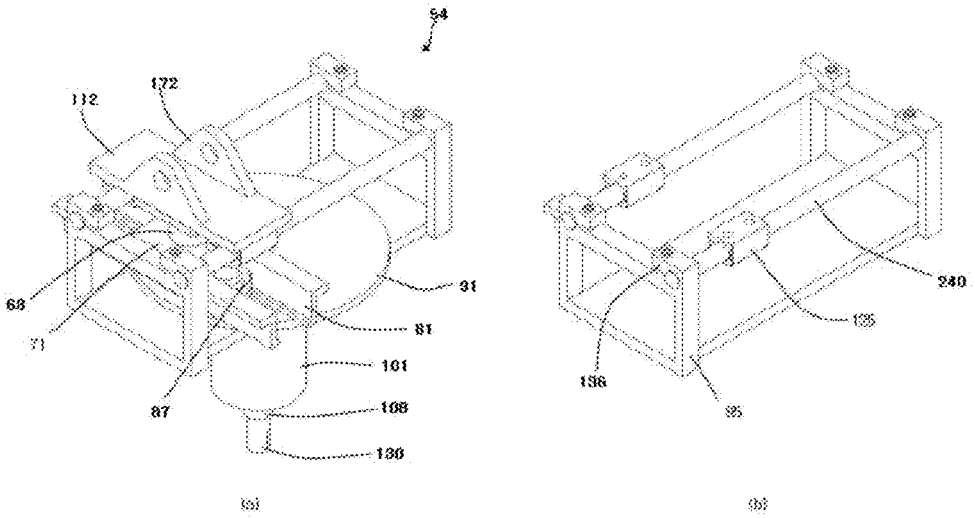
FIG. 21 a is a perspective view illustrating a leftward and rightward oscillation apparatus part 2(84).

The driving force generated by the pedals is transferred through the sprocket 1 (15), the chain 96, the sprocket 2 (16) and the bevel gear 1 (46), and the transfer direction changes to the direction of the rotary shaft by means of the bevel gear 2 (47) engaged in the right angle direction at the bevel gear 1 (46) and is transferred to the rotary shaft 130 of the leftward and rightward oscillation apparatus part 1 (S3) or the leftward and rightward oscillation apparatus part 2 (S4) through the driving force transfer shaft 120 and the universal joint 64 provided in the parallel direction from the oscillation body support part 110. The driving force transfer shaft 120 is provided in parallel with the oscillation body support part 110 and is inclined. A difference occurs in angles in the direction of the rotary shaft when connecting to the rotary shaft 130. In order to compensate for the above mentioned difference, the universal joint 64 is provided between the driving force transfer shaft 120 and the rotary shaft 130. At this time, the sprocket 1 (15), the chain 96 and the sprocket 2 (16) of the driving force generation part S1 and the driving force transfer part S2 might be substituted with a belt-driven driving force transfer method. The driving force generating from the pedaling can be transferred by means of the pulley 1, the driving force transfer belt and the pulley 2 (not shown) which correspond to each element. The rotational force of the driving force transfer shaft 120 and the universal joint 64 can be transferred to the rotary shaft 130 of the leftward and rightward oscillation apparatus part 1 (S3) or the leftward and rightward oscillation apparatus part 2 (S4) through the bevel gear 1 (46) and the bevel gear 2 (47). As shown in FIGS. 18 and 19, the leftward and rightward oscillation apparatus part 1 (S3) comprises an oscillation body base plate 1 (111), a roller slider 65, a connection post 68, a post fixing pin 71, a guide rail 75, a roller guide 81, a disk roller 87, a rotation disk 91, a slide frame 95, a stem 101, a long bush 105 and a rotary shaft 130. The universal joint 64 of the driving force transfer part S2 is connected to one side of the rotary shaft 130 rotating being inserted in the long bush 105, and the other side of the rotary shaft 130 is fixed at the rotation disk 91, and a rotatable disk roller 87, which is rotatable randomly, is provided at an eccentric portion above the rotation disk 91, so the disk roller 87 performs an eccentric rotation about the rotary shaft of the rotation disk 91. The step 101 is fixed at a lower side of the slide frame 95 so as to support the whole portions of the leftward and rightward oscillation apparatus part 1 (S3) or the leftward and rightward oscillation apparatus part 2 (84) while it is fixed at the oscillation body support part 110 as well. As shown in FIG. 19, The leftward and rightward oscillation apparatus part 1 (S3) has a guide rail 75 at the upper portion from the slide frame 95, and at the guide rail 75 is engaged the roller slider 67 provided at both lower sides of the oscillation body base plate 1 (111), so it can slide in the leftward and rightward directions. At the other end of the lower side of the oscillation body base plate 1 (111) are engaged the connection post 68, the post fixing piece 71 and the roller guide 81 in an integrated structure. As show in FIGS. 20*a* to 20*f*, the disk roller 87 is inserted into the interior of the roller guide 81. When the disk roller 87 eccentrically rotates about the rotary shaft of the rotation disk 91, the disk roller 87 pressurizes the inner wall of the roller guide 81, so the roller guide 81, the post fixing piece 71, the connection post 68 and the oscillation body base plate 1 (111) straight reciprocate along the guide rail 75 by means of the roller slider 67. In other words, the rotational motions of the rotary shaft 130 are converted into the linear reciprocation motions of the oscillation body base plate 1 (111). FIGS. 20*a* to 20*f* illustrate the conversion procedures. As shown in FIG. 21, the leftward and rightward oscillation apparatus part 2 (S4) might be configured in another way to substitute the leftward and rightward oscillation apparatus part 1 (S3). The roller slide 67 and the guide rail 75 which are the elements of the leftward and rightward oscillation apparatus part 1 (S3) can be substituted with the linear bush 125 and the guide shaft 240, respectively, and the shaft holder 136 is provided at the top of the slide frame 95 for fixing each guide shaft 240. The remaining elements are same as the leftward and rightward oscillation apparatus part 1 (S3). In other words, the leftward and rightward oscillation apparatus part 2 (S4) comprises a guide shaft 240 at the top from the slide frame 95, and at the guide shaft 240 is provided a linear bush 125 which is provided at both lower sides of the oscillation body base plate 2 (112), so it can slide in both directions. At the other lower side of the oscillation body base plate 2 (112) are provided the connection post 68, the post fixing piece 71 and the roller guide 81 which are coupled with each other as one structure. In the interior of the roller guide 81 is inserted the disk roller 87. As the disk roller 87 rotates eccentrically about the rotary shaft of the rotation disk 91, the disk roller 87 pressurizes the inner wall of the roller guide 81, so that the roller guide 81, the post fixing pin 71, the connection post 68 and the oscillation body base plate 2 (112) can linearly reciprocate along the guide shaft 240 by means of the linear bush 125. Except for the constructions formed of the driving force generation part S1, the driving force transfer part S2 and the leftward and rightward oscillation apparatus part 1 (S3) or the leftward and rightward oscillation apparatus part 2 (S4) which form the health bike of the present invention, the health bike apparatus part S5, as shown in FIG. 17, might further comprise a saddle 4, a saddle rest 172, a handle bar 24, a head tube 146, a head tube support part 151, a flywheel 132, a support part 165 and an oscillation body support part 110. As shown in FIG. 17, the saddle rest 172 is provided at the top of the oscillation body base plate 1 (111) or the oscillation body base plate 2 (112), and at the top of the saddle rest 172 is provided a saddle 4 for the user to adjust the angle of the saddle. The user supports the body by holding the handle bar 24. The head tube 146 supporting the handle bar 24 and the head tube support part 151 supporting the head tube 146 are fixed at the support part 165, and the flywheel 132 serving as a rotating weight for the purpose of increasing the effects of the exercises when the user pedals rotates by receiving a rotational force of the pedaling disk 131 through the flywheel belt 156. The support part 165 is provided at the bottom and is engaged with the head tube support part 151 and the oscillation body support part 110 for thereby serving as the basic frame like the frame of the present invention.

The constructions and operations of the present invention will be described.

The present invention comprises a driving force generation part S1, a driving force transfer part S2, a leftward and rightward oscillation apparatus part 1 (S3) or a leftward and rightward oscillation apparatus part 2 (S4) and a health bike apparatus part 85. When the user applies forces with feet to the pedal 2 of the driving force generation part S1, a rotational force generates in proportion to the length of the crank arm 13 about the crank rotary shaft 14 of the pedals 2, and the sprocket 1 (15) provided at the crank rotary shaft 14 rotates, and the rotational force enables the sprocket 2 (16) and the bevel gear 1 (46) provided on the same axis as the sprocket 2 (16) to rotate as the rotational force is transferred through the chain 96 of the driving force transfer part S2, and the bevel gear 2 (47) engaged vertically at the bevel gear 1 (46), the driving force transfer shaft 120 provided in the axial direction of the bevel gear 2 (47) and the universal joint 64 provided at the other end of the driving force transfer shaft 120 rotate. The rotary shaft 130 of the leftward and rightward oscillation apparatus part 1 (S3) is engaged at the universal joint 64, so it rotates at the inner side of the long bush 105, and the other end of the rotary shaft 130 is fixed at the rotary disk 91, so the disk roller 87 above the rotation disk 91 eccentrically rotates about the rotary shaft of the rotation disk 91.

The disk roller 87 is inserted in the inner side of the roller guide 81. Since the roller guide 81 is engaged together with the oscillation body base plate 1 (111), the roller slide 67, the connection post 68 and the post fixing piece 71 and operates as one body, so the disk roller 87 performs an eccentric rotation motion about the rotary shaft of the rotation disk 91. The oscillation body base plate 1 (111), the roller slide 67, the connection post 68, the post fixing piece 71 and the roller guide 81 come to reciprocate in leftward and rightward directions along the guide rail 75. So, the saddle rest 172 provided at the top of the oscillation body base plate 1 (111) and the saddle 4 provided at the saddle rest 172 reciprocate in leftward and rightward directions. The leftward and rightward oscillation apparatus part 2 (S4) might be substituted with a leftward and rightward oscillation apparatus part 1(S3). The disk roller 87 is inserted into the inner side of the roller guide 81, and the roller guide 81 is engaged with the oscillation body base plate 2 (112), the linear bush 125, the connection post 68 and the post fixing piece 71 and operates as one body, so the disk roller 87 eccentrically rotate about the rotary shaft of the rotation disk 91. The oscillation body base plate 2 (112), the linear bush 120, the connection post 68 the post fixing piece 71 and the roller guide 81 reciprocate in leftward and rightward directions along the guide shaft 240. The saddle rest 172 provided at the top of the oscillation body base plate 2 (112) and the saddle 4 provided at the saddle rest 172 reciprocate in leftward and rightward directions. At this time, the sprocket 1 (15) of the driving force generation part 81 and the driving force transfer part S2, the chain 96 and the sprocket 2 (16) can be substituted with a belt type driving force transfer method. The generating driving force can be transferred by the pulley 1, the driving force transfer belt and the pulley 2 (not shown) corresponding to the above mentioned elements, respectively, as the user pedals, so the rotational force of the driving force transfer shaft 120 and the universal joint 64 can be transferred to the rotary shaft 130 of the leftward and rightward oscillation apparatus part 1 (S3) or the leftward and rightward oscillation apparatus part 2 (54) through the bevel gear 1 (46) or the bevel gear 2 (47). Since the saddle can oscillate in leftward and rightward directions using the driving force generating during the pedaling motions, the exercises can be effectively performed on the whole bodies such as pelvis, vertebra and abdomen along with legs. The construction having features in that the saddle oscillates in leftward and rightward directions can be identically adapted to a typical road race bicycle for the sake of the same effects. It is obvious that the simple modifications and applications of the constructions that the saddle is made to reciprocate in leftward and rightward directions by converting the rotational motions of the leftward and rightward oscillation apparatus part 1 (53) and the leftward and rightward oscillation apparatus part 2 (S4) and that the saddle is made to slide in leftward and rightward directions by using the roller slide 67 and the guide rail 75 or the linear bush 125 and the guide shaft 240 belong to the ranges of the present invention.

The invention claimed is:

1. A health bike saddle structure, comprising:

an operation part (100)to which a rotational force is supplied from a driving force of pedals (2);

a leftward and rightward driving part (200) the position of which changes in leftward and rightward directions by the rotations of the operation part; and a forward and backward driving part (300) which is fixedly engaged at the top of the leftward and rightward driving part and is engaged with a saddle (4), so the positions of the same can be adjusted in forward and backward directions, and the leftward and rightward driving part (200) and the forward and backward driving part (300) are integrally engaged by way of a bracket (230) fixed at a top of the leftward and rightward driving part, and as the operation part (100) is engaged with an inner side of the leftward and rightward driving part and rotates in one direction, the positions of the leftward and rightward driving part (200) are changed wherein the operation part (100) comprises an oscillation body support part (110) which has a hollow interior;

a driving force transfer shaft (120) which is inserted into an inner space of the oscillation body support part for the driving force of the pedals to be transferred by arranging a worm gear at a lower side of the pedals;

a rotary shaft (130) which is positioned overlapped with the top of the driving force transfer shaft and rotates in sync with the driving force transfer shaft;

a gyroscope (140) which is bolt-engaged in a perpendicular direction at the top of the rotary shaft; and a pressurizing protrusion (150) which is fixedly engaged at an end portion of the gyroscope, wherein the leftward and rightward driving part (200) comprises:

a support housing (220) whose bottom is formed in a rectangular frame shape;

a pair of guide shafts (240) which are arranged crossing the support housing's side surface at the inner side thereof;

an engaged ball bush (210);

a guide frame (250) which is engaged at an inner upper surface of a lock; and a bracket (230) integrally engaging the front and back driving part (300) and the support housing (220), wherein the front and back driving part (300) comprises:

a pair of guide shafts (240) which are installed opposite to each other in a longitudinal direction of the saddle;

a support holder (310) supporting the saddle by fixing both ends; and a ball bush (210) for fixedly engaging both ends, and wherein a plurality of fixing plates (160) are fixedly arranged on the same line at the top of the oscillation body support part (110), and the ball bush (210) of the leftward and rightward driving part (200) is engaged to the fixing plate (160), so the position of the ball bush (210) engaged with the guide shaft (240) does not change.

2. The saddle structure of claim 1, wherein the pressurizing protrusion (150) of the operation part (100) is arranged in engagement with the guide frame (250) provided at the leftward and rightward driving part (200) and allows the pressurizing protrusion (150) held by the guide frame (250) to linearly reciprocate in a space formed by the guide frame.

3. The saddle structure of claim 1, wherein as the pressurizing protrusion (150) pushes one side of the guide frame (250) by means of the rotational operation of the rotary shaft (130) and the gyroscope (140), the position of the support housing (220) changes in the leftward and rightward directions about the ball bush (210).

4. The saddle structure of claim 1, wherein the ball bush (210) of the frontward and backward driving part (300) further comprises a plate (340) at the bottom for the sake of fixing and engagement with the bracket (230), and as the positions of the guide shaft (240) and the support holder (310) change about the ball bush (210), the front and back positions of the saddle change.

5. A health bike in exercise instrument which can help perform a leg exercise and a waist exercise at a fixed place in an indoor space by comprising a base frame (10) supporting and fixing an exercise instrument, a handle part (2000) fixed at the base frame (10), a pedal part (3000) for performing a cycling exercise as a user pedals with his feet on the pedal part, a driving pulley (34) and a driving sprocket (31) integrally engaged with the pedal part (3000) for the sake of a rotational operation, and a rotation torque adjusting means (42) adjusting a holding force of the driving pulley (34), comprising:

a saddle part (7000) which oscillates in leftward and rightward directions as a user sits on the saddle part;

an oscillation instrument (5000) performing an eccentric motion by receiving a rotational force from the pedal part (3000); and an oscillation adjusting part (6000) which makes the saddle part (7000) perform a leftward and rightward oscillation motion by using an eccentric motion of the oscillation instrument (5000) and adjusts an oscillation motion width, wherein the oscillation instrument 5000 comprises:

a driven sprocket 51 receiving a horizontal driving force of a driving sprocket 31 of the pedal part 3000;

a vertical and horizontal rotation bevel gears 53 and 52 which covert the horizontal rotational force of the driven sprocket 51 into a vertical rotational force;

a horizontal shaft 54 fixing the driven sprocket 51 and the horizontal rotation bevel gear 52;

a bearing and bearing housing 55 fixing and rotating the horizontal shaft 54;

an external rotary shaft 56 and an internal rotary shaft 56*a* which are fixed at the vertical rotation bevel gear 53 and rotate in the vertical direction and are flexible in upward and downward directions; and an oscillation instrument 5000 formed of a key groove 56*b* and a protrusion which slide on the external rotary shaft 56 and the internal rotary shaft 56*a*.

6. The health bike of claim 5, wherein the leftward and rightward motions of the oscillation instrument (5000) are synchronized for the maximum leftward and rightward oscillation angle of the saddle (4) to be matched with the top dead point and bottom dead point of the cranks of the pedals (2) with the driving ratio of the driven sprocket (51) receiving a horizontal driving force of the driving sprocket (31) of the pedal part (3000) being 1:1, with the driving ratio of the vertical and horizontal rotation bevel gears converting the horizontal rotation force of the driven sprocket (51) into the vertical rotational force being 1:1.

* * * * *